US009093748B2

(12) United States Patent
Guan et al.

(10) Patent No.: US 9,093,748 B2
(45) Date of Patent: Jul. 28, 2015

(54) DIPOLE ANTENNA

(75) Inventors: Ning Guan, Sakura (JP); Hiroiku Tayama, Sakura (JP)

(73) Assignee: FUJIKURA LTD., Tokyo (JP)

( * ) Notice: Subject to any disclaimer, the term of this patent is extended or adjusted under 35 U.S.C. 154(b) by 801 days.

(21) Appl. No.: 13/356,296

(22) Filed: Jan. 23, 2012

(65) Prior Publication Data

US 2012/0119966 A1 May 17, 2012

Related U.S. Application Data

(63) Continuation of application No. PCT/JP2010/062445, filed on Jul. 23, 2010.

(30) Foreign Application Priority Data

Jul. 24, 2009 (JP) ..... 2009-173614
Jul. 24, 2009 (JP) ..... 2009-173615

(51) Int. Cl.
*H01Q 9/26* (2006.01)
*H01Q 5/357* (2015.01)
*H01Q 5/40* (2015.01)

(52) U.S. Cl.
CPC ..... *H01Q 9/26* (2013.01); *H01Q 5/357* (2015.01); *H01Q 5/40* (2015.01)

(58) Field of Classification Search
CPC ..... H01Q 9/26; H01Q 5/357; H01Q 5/40
USPC ..... 343/793, 803, 804, 806, 795
See application file for complete search history.

(56) References Cited

U.S. PATENT DOCUMENTS 3,229,298 A 1/1966 Morgan
3,231,894 A * 1/1966 Nagai ..... 343/806
5,453,752 A 9/1995 Wang et al.
5,589,842 A 12/1996 Wang et al.

(Continued)

FOREIGN PATENT DOCUMENTS

DE 197 03 864 A1 6/1998
EP 1942553 A1 7/2008

(Continued)

OTHER PUBLICATIONS

Agrawall, Narayan Prasad, et al., "Wide-Band Planar Monopole Antennas", IEEE Transactions on Antennas and Propagation, Feb. 1998, pp. 294-295, vol. 46, No. 2.

(Continued)

*Primary Examiner* — Michael C Wimer
(74) *Attorney, Agent, or Firm* — Sughrue Mion, PLLC

(57) ABSTRACT

A dipole antenna of the present invention is more compact and has a wider bandwidth as compared with a conventional dipole antenna. A dipole antenna (DP) includes antenna elements (E1) and (E2) on a single plane. (E1) includes a linear section (E1*a*) extending from an end of (E1) in a first direction, and a linear section (E1*b*) connected to (E1*a*) via a bending section (E1*c*), (E1*b*) extending from (E1*c*) in a direction opposite to the first direction. (E2) includes a linear section (E2*a*) extending from an end of (E2) in the direction opposite to the first direction, and a linear section (E2*b*) connected to (E2*a*) via a bending section (E2*c*), (E2*b*) extending from (E2*c*) in the first direction. (E1) and (E2) are such that (E1*a*) is provided between (E2*a*) and (E2*b*), and (E2*a*) is provided between (E1*a*) and (E1*b*).

19 Claims, 27 Drawing Sheets

(56) References Cited

U.S. PATENT DOCUMENTS

| | | | | |
|---|---|---|---|---|
| 6,285,342 | B1 * | 9/2001 | Brady et al. | 343/895 |
| 6,417,816 | B2 * | 7/2002 | Sadler et al. | 343/795 |
| 2004/0201522 | A1 | 10/2004 | Forster | |
| 2007/0085751 | A1 | 4/2007 | Kai et al. | |
| 2009/0128440 | A1 | 5/2009 | Tavassoli Hozouri | |

FOREIGN PATENT DOCUMENTS

| | | | |
|---|---|---|---|
| JP | 07-131231 | A | 5/1995 |
| JP | 2002-280817 | A | 9/2002 |
| JP | 2005-210151 | A | 8/2005 |
| JP | 2006-135775 | A | 5/2006 |
| JP | 2007-116300 | A | 5/2007 |

OTHER PUBLICATIONS

Chen, Zhi Ning, "Broadband Roll Monopole", IEEE Transactions on Antennas and Propagation, Nov. 2003, pp. 3175-3177, vol. 51, No. 11.

Kraus, J. D., et al, "Antennas for All Applications: The Thin Linear Antenna", McGraw Hill, Third Edition, 2002, pp. 177-181.

Samaddar, Surendra N., "Biconical Antennas with Unequal Cone Angles", IEEE Transactions on Antennas and Propagation, Feb. 1998, pp. 181-193, vol. 46, No. 2.

Sandler, Sheldon S., et al., "Compact Conical Antennas for Wide-Band Coverage", IEEE Transactions on Antennas and Propagation, Mar. 1994, pp. 436-439, vol. 42, No. 3.

Shlager, Kurt L., et al., "Optimization of Bow-Tie Antennas for Pulse Radiation", IEEE Transactions on Antennas and Propagation, Jul. 1994, pp. 975-982, vol. 42, No. 7.

Wu, Xuan Hui, et al., "Comparison of Planar Dipoles in UWB Applications", IEEE Transactions on Antennas and Propagation, Jun. 2005, pp. 1973-1983, vol. 53, No. 6.

Office Action issued by Chinese Patent Office in Chinese Application No. 201080032828.5 dated Aug. 28, 2013.

Search Report issued in European Application No. 10802345.8 dated Jul. 23, 2013.

Notice of Allowance issued by Japanese Patent Office in Japanese Application No. 2011-523710 dated Oct. 22, 2013.

* cited by examiner (a)

(b)

(c)

(a)

(b)

(c)

DIPOLE ANTENNA

CROSS-REFERENCE TO RELATED APPLICATIONS

This application is a Continuation of PCT International Application Serial No. PCT/JP2010/062445 filed Jul. 23, 2010.

This application is based upon and claims the benefit of priority from prior Japanese Patent Application No. 2009-173614 filed Jul. 24, 2009 and Japanese Patent Application No. 2009-173615 filed Jul. 24, 2009.

TECHNICAL FIELD

The present invention relates to a dipole antenna, particularly, a novel dipole antenna having a specific structure in the vicinity of a feed point.

BACKGROUND ART

Antennas have been long used as devices for converting a high-frequency current into an electromagnetic wave and an electromagnetic wave into a high-frequency current. The antennas are categorized into subgroups such as linear antennas, planar antennas, and solid antennas, based on their shapes. The linear antennas are further categorized into subgroups such as a dipole antenna, a monopole antenna, and a loop antenna. A dipole antenna having a linear antenna element has a significantly simple structure (see Non-patent Literature 1), and is now used widely as a base station antenna etc. Further, there has been known a planar dipole antenna which includes a planar antenna element in place of the linear antenna element (see Non-patent Literature 2).

(a) of FIG. 30 illustrates a structure of a conventional dipole antenna dp. The dipole antenna dp includes (i) a linear antenna element e1 extending from a feed point F in a first direction, and (ii) a linear antenna element e2 extending from the feed point F in a direction which is opposite to the first direction. The dipole antenna dp serves as a transmitting antenna for converting a high-frequency current into an electromagnetic wave or a receiving antenna for converting an electromagnetic wave into a high-frequency current. Note, however, that a high-frequency current (electromagnetic wave) that can be efficiently converted into an electromagnetic wave (high-frequency current) by use of the dipole antenna dp is limited to the one which has a frequency in the vicinity of a resonance frequency of the dipole antenna dp.

(b) of FIG. 30 illustrates current distribution (fundamental mode) at a first resonance frequency f1 of the dipole antenna dp. At the first resonance frequency f1, a direction in which a current flows through the antenna element e1 and a direction in which a current flows through the antenna element e2 are identical with each other (see (b) of FIG. 30). Accordingly, in a case where a high-frequency current having a frequency in the vicinity of the first resonance frequency f1 is received via the feed point F, an electromagnetic wave having a single-peaked radiation pattern is radiated from the antenna elements e1 and e2.

(c) of FIG. 30 illustrates current distribution (higher order mode) at a second resonance frequency f2 of the dipole antenna dp. At the second resonance frequency f2, a direction in which a current flows through the antenna element e1 and a direction in which a current flows through the antenna element e2 are different from each other (see (c) of FIG. 30). More specifically, two points in antenna elements e1 and e2, indicating a ⅓ point of an entire length of a combined antenna elements e1 and e2 and a ⅔ point of the entire length, respectively, serve as two nodes of the current distribution, so that a direction in which current flows through the antenna elements e1 and e2 is inverted at each of the two nodes. For this reason, in a case where a high-frequency current having a frequency in the vicinity of the second resonance frequency f2 is received via the feed point F, an electromagnetic wave having a split radiation pattern is radiated from the antenna elements e1 and e2. This is because electromagnetic waves radiated from sections of the antenna element f1 and sections of the antenna element f2 interfere with each other so that an intensity of an electromagnetic wave is significantly weakened in a specific direction as compared with the other directions.

CITATION LIST

Non-Patent Literature

[Non-Patent Literature 1]

J. D. Kraus and R. J. Marhefka, Antennas For All Applications, the third edition, U.S., McGraw Hill, 2002, p 178-181.

[Non-Patent Literature 2]

Xuan Hui Wu, Comparison of Planar Dipoles in UWB Applications, IEEE TRANSACTIONS ON ANTENNAS AND PROPAGATION, VOL. 53, No. 6, June 2005.

SUMMARY OF INVENTION

Technical Problem

However, a conventional dipole antenna has disadvantages of (i) a large body and (ii) a narrow operation bandwidth. The following description deals with such problems more specifically.

(1) Large Body

In a case where an electromagnetic wave having a wavelength λ is radiated by use of the fundamental mode having the first resonance frequency, it is necessary to employ a dipole antenna whose entire length is approximately λ/2. Further, in a case where an electromagnetic wave having a wavelength λ is radiated by use of the higher order mode having the second resonance frequency, it is necessary to employ a dipole antenna whose entire length is approximately 3λ/2. For example, in a case where an electromagnetic wave within a digital terrestrial television bandwidth (not less than 470 MHz but not more than 900 MHz) is radiated by use of the fundamental mode, it is necessary to employ a dipole antenna whose entire length is not less than 30 cm. It is difficult to provide such a long antenna in a mobile phone terminal or a personal computer. In the case of the higher order mode, it becomes necessary to employ a further longer antenna.

Furthermore, in a case where an electromagnetic wave of 2 GHz (wavelength: 15 cm) is radiated by use of the fundamental mode, it is necessary to employ a dipole antenna whose entire length is approximately 7.5 cm. It is difficult to provide such a long antenna in a mobile phone terminal or a personal computer. In the case of the higher order mode, it becomes necessary to employ a further longer antenna.

(2) Narrow Operation Bandwidth

Generally, in order to radiate efficiently an electromagnetic wave corresponding to a certain frequency, it is necessary that (i) an input reflection coefficient (ratio of reflected power to input power, i.e., an amplitude $|S_{1,1}|$ of a component $S_{1,1}$ of an S matrix) at the certain frequency is low, and (ii) a radiant gain at the certain frequency is high. Accordingly, in a case where the input reflection coefficient is significantly low within a certain bandwidth (i.e., in the vicinity of the resonance frequency) but the radiant gain is significantly low within the certain bandwidth, it is impossible to use the certain bandwidth as the operation bandwidth. On the other hand, in a case where the radiant gain is significantly high within a certain bandwidth but the input reflection coefficient is significantly high within the certain bandwidth, it is also impossible to use the certain bandwidth as the operation bandwidth.

The following description deals with an operation bandwidth of a conventional dipole antenna in accordance with a specific example illustrated in FIG. 31.

A dipole antenna 90 illustrated in FIG. 31 has an arrangement in which antenna elements 91 and 92, each being made of an electrically conductive wire (length: 40 mm, radius: 1 mm), are arranged in line with a gap of 2 mm between them. Note that the following properties of the dipole antenna 90 were obtained on the basis of a numeric simulation which was based on a premise that a system characteristic impedance was 50Ω.

(a) of FIG. 32 shows frequency dependency of the input reflection coefficient $S_{1,1}$ of the dipole antenna 90, and (b) of FIG. 32 shows frequency dependency of a radiant gain $G_0$ of the dipole antenna 90. Note that the radiant gain $G_0$ shown in (b) of FIG. 32 is a radiant gain with respect to a direction of "θ=90°" (θ indicates a deflection angle with respect to a z axis in a polar coordinate system).

As is clear from (a) of FIG. 32, the dipole antenna 90 has a first resonance frequency f1 of 1.7 GHz, and a second resonance frequency f2 of 5.0 GHz. For example, in a case where an operation condition of $|S_{1,1}| \leq -5.1$ dB is set with respect to the input reflection coefficient $S_{1,1}$, the operation bandwidth is constituted by (i) a bandwidth of not less than 1.5 GHz but not more than 1.9 GHz (fractional bandwidth: 24%) and (ii) a bandwidth of not less than 4.7 GHz but not more than 5.4 GHz (fractional bandwidth: 14%). Note that a value of the input reflection coefficient $S_{1,1}$ is a value based on the premise that the input characteristic impedance is 50Ω (this also applies to each of the following values of the input reflection coefficient). Here, the "fractional bandwidth" of a certain bandwidth indicates a ratio of the certain bandwidth to a center frequency of the certain bandwidth.

However, as shown in (b) of FIG. 32, the radiant gain $G_0$ of the dipole antenna 90 shows a local maximum value at a frequency of 4.3 GHz ($f_{G0max}$=4.3 GHz), which is lower than the second resonance frequency f2. As the frequency is increased from 4.3 GHz, the radiant gain $G_0$ is sharply reduced. For this reason, depending on the operation condition set with respect to the radiant gain $G_0$, there is a case where it is impossible to use, as the operation bandwidth, an entire bandwidth in the vicinity of the second resonance frequency f2 (not less than 4.7 GHz but not more than 5.4 GHz) but only a part of the bandwidth, which entire bandwidth satisfies the operation condition set with respect to the input reflection coefficient $S_{1,1}$. For example, in a case where the operation condition set with respect to the radiant gain $G_0$ is such that the radiant gain $G_0$ is not less than 2 dBi, it is impossible to use, as the operation bandwidth, a bandwidth of not less than 4.9 GHz among the bandwidth in the vicinity of the second resonance frequency f2 (not less than 4.7 GHz but not more than 5.4 GHz), which satisfies the operation condition set with respect to the input reflection coefficient $S_{1,1}$.

There is a gradual increase in radiant gain $G_0$ in a bandwidth of not more than 4.3 GHz. Note that this gradual increase is a phenomenon generated due to concentration of a radiation pattern in a direction of "θ=90°" in this bandwidth. Further, a sharp decrease in radiant gain $G_0$, which could be generated in the bandwidth of not less than 4.3 GHz, is a phenomenon generated due to a split radiation pattern in this bandwidth.

(a) through (c) of FIG. 33 show radiation patterns at corresponding frequencies, respectively. (a) of FIG. 33 shows a radiation pattern at a frequency of 1.7 GHz (in the vicinity of the first resonance frequency). (b) of FIG. 33 shows a radiation pattern at a frequency of 3.4 GHz (in the bandwidth where the radiant gain $G_0$ gradually increases). As is clear from the radiation patterns shown in (a) and (b) of FIG. 33, the radiation pattern is gradually concentrated in the direction of "θ=90°" in the bandwidth of not more than 4.3 GHz, where the radiant gain $G_0$ gradually increases. Further, (c) of FIG. 33 shows a radiation pattern at a frequency of 5.1 GHz (in the bandwidth where the radiant gain $G_0$ sharply decreases). As is clear from the radiation pattern shown in (c) of FIG. 33, the radiation pattern is split in the bandwidth of not less than 4.3 GHz, where the radiant gain $G_0$ sharply decreases.

FIG. 34 is a graph showing frequency dependency of HPBW (Half Power Band Width)/2 with respect to the direction of "θ=90°". The HPBW is an amount defined as a difference between deflection angles θ, at each of which the radiant gain $G_0$ becomes −3 [dBi]. The HPBW becomes small as the concentration of the radiation pattern in the direction of "θ=90°" is increased. As is clear from FIG. 34, the radiation pattern is gradually concentrated in the direction of "θ=90°" in the bandwidth of not more than 4.3 GHz, where the radiant gain $G_0$ gradually increases.

The present invention is made in view of the problems. An object of the present invention is to provide a dipole antenna which is more compact than that of a conventional dipole antenna and has a wider operation bandwidth than that of the conventional dipole antenna.

Solution to Problem

In order to attain the object, a dipole antenna of the present invention includes: a first antenna element; and a second antenna element, the first antenna element including: a first linear section extending from a first feed point in a first direction; and a second linear section being connected to one of ends of the first linear section via a first bending section, which one of ends of the first linear section is on a side opposite to the first feed point, the second linear section extending from the first bending section in a direction opposite to the first direction, the second antenna element including: a third linear section extending from a second feed point in the direction opposite to the first direction; and a fourth linear section being connected to one of ends of the third linear section via a second bending section, which one of ends of the third linear section is on a side opposite to the second feed point, the fourth linear section extending from the second bending section in the first direction.

According to the arrangement, it is possible to cause a direction in which a current flowing through the first antenna element at a second resonance frequency and a direction in which a current flowing through the second antenna element at the second resonance frequency to be identical with each other. This shifts the second resonance frequency toward a low-frequency side. That is, it is possible to cause a radiation pattern at the second frequency to be a single-peaked radiation pattern.

Here, such a single-peaked radiation pattern at the second resonance frequency means that the second resonance frequency is shifted toward the low-frequency side with respect to a frequency at which a radiant gain shows a local maximum value, that is, there is no sharp reduction in radiant gain between the first resonance frequency and the second resonance frequency. Accordingly, it is possible to use, as an operation bandwidth satisfying an operation condition set with respect to the radiant gain, a bandwidth in the vicinity of the second resonance frequency, which bandwidth could not be used as the operation bandwidth with a conventional arrangement due to a sharp reduction in radiant gain.

Further, the second resonance frequency is shifted toward the low-frequency side, so that the first resonance frequency and the second resonance frequency become close to each other. As a result, an input reflection coefficient is reduced through an entire bandwidth between the first resonance frequency and the second resonance frequency. Moreover, there is no sharp reduction in radiant gain between the first resonance frequency and the second resonance frequency, as described above. Accordingly, depending on an operation condition set with respect to the input reflection coefficient, it is possible to use, as the operation bandwidth, the entire bandwidth between the first resonance frequency and the second resonance frequency.

That is, by allowing the bandwidth in the vicinity of the second resonance frequency to be included in the operation bandwidth, which bandwidth could not be used as the operation bandwidth with the conventional arrangement, it is possible to widen the operation bandwidth.

Further, with the aforementioned arrangements of the first antenna element and the second antenna element, it is also possible to realize a dipole antenna whose entire length is identical with that of a conventional dipole antenna but which is more compact than the conventional dipole antenna.

Note that the "direction" of the "first direction" is an oriented direction. That is, in a case where a direction from south to north is the first direction, for example, a direction from north to south is the direction opposite to the first direction.

Advantageous Effects of Invention

A dipole antenna of the present invention includes: a first antenna element; and a second antenna element, the first antenna element including: a first linear section extending from a first feed point in a first direction; and a second linear section being connected to one of ends of the first linear section via a first bending section, which one of ends of the first linear section is on a side opposite to the first feed point, the second linear section extending from the first bending section in a direction opposite to the first direction, the second antenna element including: a third linear section extending from a second feed point in the direction opposite to the first direction; and a fourth linear section being connected to one of ends of the third linear section via a second bending section, which one of ends of the third linear section is on a side opposite to the second feed point, the fourth linear section extending from the second bending section in the first direction. It is therefore possible to realize a dipole antenna which (i) is more compact than a conventional dipole antenna and (ii) has a wider operation bandwidth than that of the conventional dipole antenna.

DESCRIPTION OF EMBODIMENTS

There are two basic arrangements of a dipole antenna of the present invention. The following description deals with a first basic arrangement, embodiments of the first basic arrangement, a second basic arrangement, and embodiments of the second basic arrangement in this order.

[First Basic Arrangement of the Present Invention]

Here, the first basic arrangement of the present invention is described below with reference to FIG. 1, which first basic arrangement is an arrangement the following specific embodiments commonly have. Then, the specific embodiments of the first basic arrangement are described.

Figure 1:
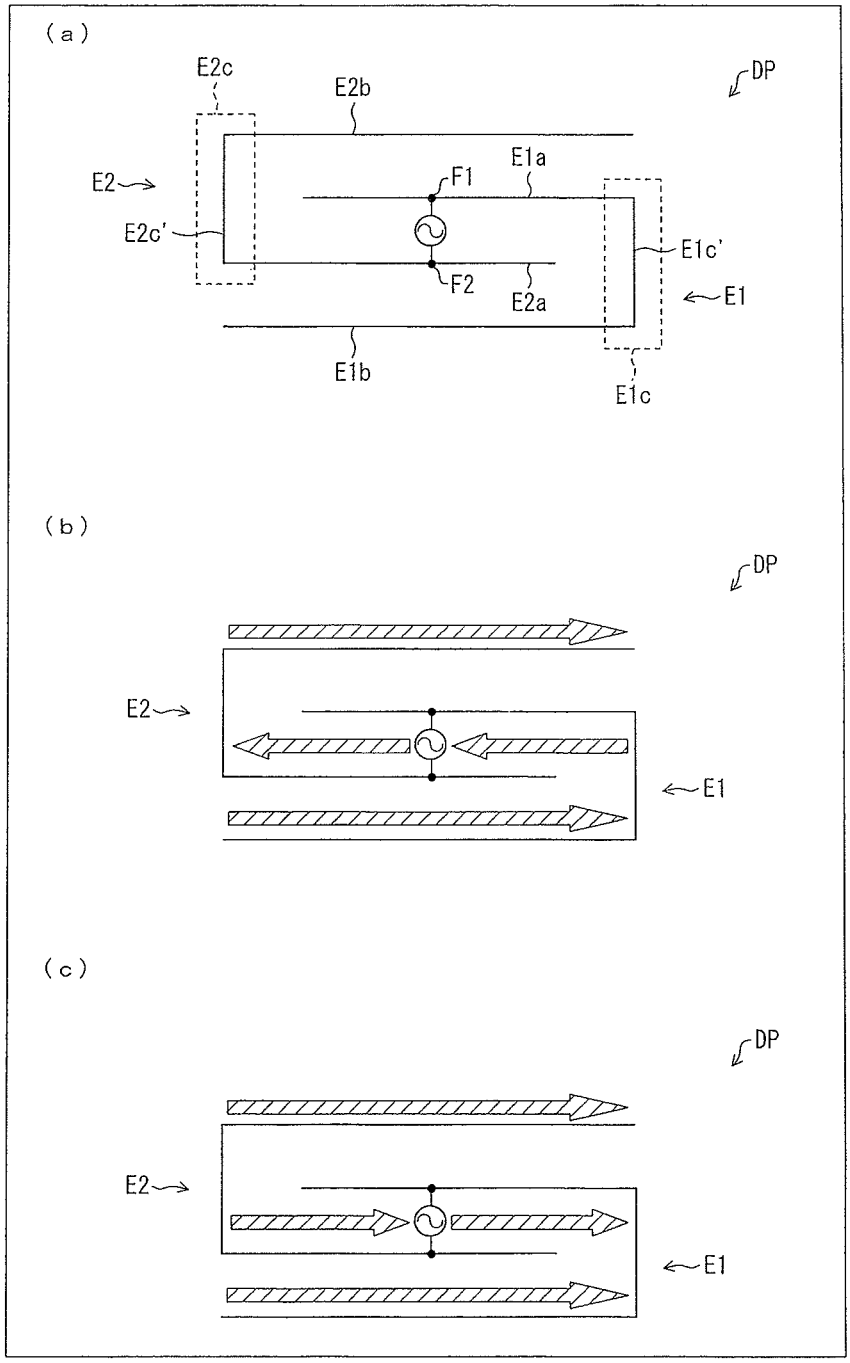
FIG. 1 is an explanatory view illustrating a dipole antenna of a first basic arrangement of the present invention: (a) of FIG. 1 is a view illustrating a structure of the dipole antenna of the first basic arrangement of the present invention; (b) of FIG. 1 is a view illustrating current distribution of the dipole antenna at a first resonance frequency; and (c) of FIG. 1 is a view illustrating current distribution of the dipole antenna at a second resonance frequency.

(a) of FIG. 1 is a view illustrating a structure of a dipole antenna DP of the present invention. The dipole antenna DP of the present invention includes two antenna elements E1 and E2, which are arranged on a single plane (see (a) of FIG. 1).

The antenna element E1 includes a linear section E1*a* (first linear section) extending from one of ends of the antenna element E1 in a first direction, and a linear section E1*b* (second linear section) being connected to the linear section E1*a* (first linear section) via a first bending section E1*c*, the linear section E1*b* (second linear section) extending from the first bending section E1*c* in a direction opposite to the first direction (see (a) of FIG. 1). In other words, the antenna element E1 is a bent element having such a U shape with no round corner but two square corners that the linear sections E1*a* and E1*b*, adjacent to each other via the bending section E1*c*, are parallel to each other.

Further, the antenna element E2 includes a linear section E2*a* (third linear section) extending from one of ends of the antenna element E2 in the direction opposite to the first direction, and a linear section E2*b* (fourth linear section) being connected to the linear section E2*a* (third linear section) via a second bending section E2*c*, the linear section E2*b* (fourth linear section) extending from the second bending section E2*c* in the first direction. In other words, the antenna element E2 is a bent element having such a U shape with no round corner but two square corners that (i) the linear sections E2*a* and E2*b*, adjacent to each other via the bending section E2*c*, are parallel to each other.

By employing the antenna elements E1 and E2 thus bent, it is possible to provide a dipole antenna which is more compact than a conventional dipole antenna employing an antenna element which is not bent.

The dipole antenna DP illustrated in (a) of FIG. 1 employs the bending section E1*c* constituted by straight line parts (i.e., a U shape with no round corner but two square corners), namely, (i) a linear section E1*c*' extending in a direction perpendicular to the first direction, (ii) one of end sections of the linear section E1*a*, which is the one closer to the linear section E1*c*', and (iii) one of end sections of the linear section E1*b*, which is the one closer to the linear section E1*c*'. Note, however, that the present invention is not limited to this, and it is possible to employ a bending section constituted by a curved line part (i.e., a U shape with a round corner) in place of the bending section E1*c* constituted by the straight line parts. This also applies to the bending section E2*c* of the antenna element E2. Note that the one of end sections of the linear section E1*a*, closer to the linear section E1*c*', is an end section (in the vicinity of an end point) on a premise that an intersection between the linear section E1*a* and the linear section E1*c*' serves as the end point. This applies to each of the other linear sections.

Further, the antenna elements E1 and E2 are arranged so that (i) the linear section E1*a* is arranged between the linear sections E2*a* and E2*b* and (ii) the linear section E2*a* is arranged between the linear sections E1*a* and E1*b* (see (a) of FIG. 1). That is, the antenna elements E1 and E2 are arranged such that (i) the linear section E1*a* is surrounded by the antenna element E2 on three sides and (ii) the linear section E2*a* is surrounded by the antenna element E1 on three sides.

By arranging the antenna elements E1 and E2 thus bent as described above, it becomes possible to provide a still more compact dipole antenna.

Electric power is supplied to the antenna element E1 via not one of end points of the antenna element E1 but a feed point F1 which is provided on an intermediate part of the linear section E1*a* between end points of the linear section E1*a*. To the antenna element E2, the electric power is supplied via a feed point F2 which is provided on an intermediate part of the linear section E2*a* between end points of the linear section E2*a* in a manner similar to the antenna element E1.

Note that the feed point F1 can be provided anywhere on the linear section E1*a* except for the end points of the linear section E1*a*. That is, the feed point F1 is provided at any position on the linear section E1*a* between the end points of the linear section E1*a*, and the position is not limited to a midpoint of the linear section E1*a* between the end points of the linear section E1*a*. This also applies to the feed point F2. Note, however, that it is preferable to provide the feed point F2 at a foot of a perpendicular extending from the feed point F1 so that a distance between the feed points F1 and F2 becomes as short as possible. Further, there is a case where the antenna elements E1 and E2 are arranged to have point symmetry with respect to each other so as to cause their radiation patterns to be symmetric with respect to each other. In this case, by arranging the feed point F1 so that the perpendicular extending from the feed point F1 to the feed point F2 passes through a center of the point symmetry, it becomes possible to increase a symmetric property (see (a) of FIG. 1).

By employing the antenna elements E1 and E2 thus bent (see (a) of FIG. 1), it is possible to provide such a dipole antenna DP that (i) a size of the dipole antenna DP is smaller than a conventional arrangement in which the antenna elements E1 and E2 are not bent, and (ii) an operation bandwidth of the dipole antenna DP is wider than that of the conventional arrangement. The following description deals with a reason why such advantages can be achieved, with reference to FIG. 1.

That is, by employing the antenna elements E1 and E2 thus bent (see (a) of FIG. 1), it is possible to cause a direction in which a current flows through the antenna element E1 at a second resonance frequency f2 and a direction in which a current flows through the antenna element E2 at the second resonance frequency f2 to be substantially identical with each other (see (c) of FIG. 1). This causes a radiation pattern at the second resonance frequency f2 to be likely to be a single-peaked pattern, and the second resonance frequency f2 is shifted toward a low-frequency side.

The single-peaked radiation pattern at the second resonance frequency f2 means that the second resonance frequency f2 is shifted toward the low-frequency side with respect to a frequency $f_{G0max}$ at which a radiant gain $G_0$ shows a local maximum value, that is, there is no sharp reduction in radiant gain $G_0$ between a first resonance frequency f1 and the second resonance frequency f2. Accordingly, in this case, it is possible to use, as an operation bandwidth satisfying an operation condition set with respect to the radiant gain $G_0$, a bandwidth in the vicinity of the second resonance frequency f2, which bandwidth could not be used as the operation bandwidth with a conventional arrangement, due to a sharp reduction in radiant gain $G_0$.

Further, in the case where the second resonance frequency f2 is shifted toward the low-frequency side, the first resonance frequency f1 and the second resonance frequency f2 become closer to each other. In this case, an input reflection coefficient $S_{11}$ is reduced through an entire bandwidth between the first resonance frequency f1 and the second resonance frequency f2. Accordingly, in the case where the radiant gain $G_0$ between the first resonance frequency f1 and the second resonance frequency f2 satisfies the operation condition, it is possible to use, depending on the operation condition set with respect to the input reflection coefficient $S_{11}$, the entire bandwidth between the first resonance frequency f1 and the second resonance frequency f2 as the operation bandwidth.

Note, however, that, at the first resonance frequency f1, the direction in which the current flows through the antenna element E1 and the direction in which the current flows through the antenna element E2 are caused to be different from each other in a space (see (b) of FIG. 1). For this reason, the radiant gain $G_0$ could be reduced in the vicinity of the first resonance frequency f1. This is because a part of an electromagnetic wave radiated from the linear section E1*b* and a part of an electromagnetic wave radiated from the linear section E2*b* are cancelled, respectively, with electromagnetic waves radiated from the respective linear sections E1*a* and E2*a*.

Figure 2:
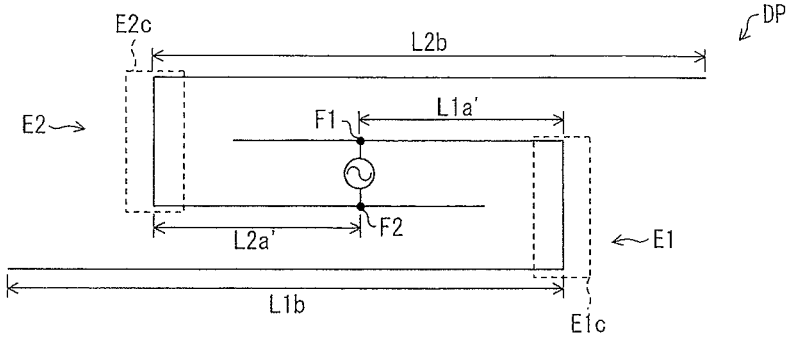
FIG. 2 is a view illustrating a preferable modified example of the dipole antenna illustrated in (a) of FIG. 1.

In the following embodiments, in order to reduce a proportion of parts of the electromagnetic waves radiated from the respective linear sections E1*b* and E2*b*, which parts are cancelled with the electromagnetic waves radiated from the respective linear sections E1*a* and E2*a*, the dipole antenna is set as illustrated in FIG. 2. That is, the dipole antenna is set so that an inequality of "L1*b*>L1*a*'+L2*a*'" and an inequality of "L2*b*>L1*a*'+L2*a*'" are satisfied (where: L1*b* is a length of the linear section E1*b*; L2*b* is a length of the linear section E2*b*; L1*a*' is a length of a part of the linear section E1*a*, which part extends to the bending section E1*c* from the feed point F1; and L2*a*' is a length of a part of the linear section E2*a*, which part extends to the bending section E2*c* from the feed point F2). With the arrangement, it is possible to suppress a reduction in radiant gain $G_0$, which reduction could be generated in the vicinity of the first resonance frequency f2.

Each of FIGS. 1 and 2 illustrates an arrangement in which the antenna element E1 terminates at one of end points of the linear section E1*b* (which one of end points is on a side opposite to a bending section E1*c* side). Note, however, that the present invention is not limited to this. That is, it is possible to modify the dipole antenna by providing the one of end points of the linear section E1*b* (which one of end points is on the side opposite to the bending section E1*c* side) with an additional element, so that the antenna element E1 does not terminate at the one of end points of the linear section E1*b* (which one of end points is on the side opposite to the bending section E1*c* side). The additional element for the antenna element E1 may be an electrically conductive film or an electrically conductive wire. A shape of the additional element for the antenna element E1 is not particularly limited. Examples of the shape of the additional element encompass various shapes such as a shape constituted by straight lines, a meander shape, a rectangular shape, etc. This also applies to the antenna element E2.

Figure 3:
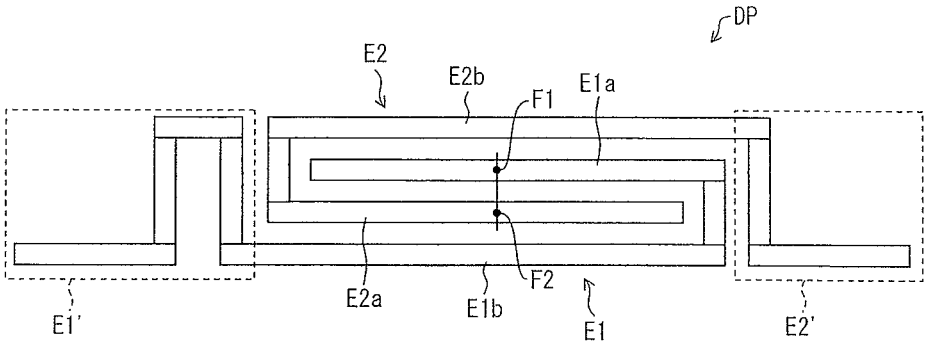
FIG. 3 is a plan view illustrating a structure of such a dipole antenna that an additional element is added to the dipole antenna illustrated in (a) of FIG. 1.

FIG. 3 illustrates an example of the dipole antenna DP, in which the additional element is provided. The dipole antenna illustrated in FIG. 3 is such that the dipole antenna DP made of an electrically conductive film is provided with an extension sections E1' and E2' each being also made of an electrically conductive film. The extension section E1' added to the antenna element E1 is such that an electrically conductive film having a width which is identical with that of each of the linear sections constituting the dipole antenna DP is formed in a meander shape. The extension section E2' added to the antenna element E2 is such that an electrically conductive film having a width which is identical with that of each of the linear sections constituting the dipole antenna DP is formed in an L shape.

With the arrangement in which the dipole antenna DP is provided with the additional elements as described above, an electrical length of the dipole antenna DP becomes longer. This makes it possible to cause a lower limit of the operation bandwidth of the dipole antenna DP to be shifted toward the low-frequency side, while ensuring a compact size of the dipole antenna DP. For example, it is possible to realize a dipole antenna which can cover a terrestrial digital television bandwidth while ensuring such a compact size of the dipole antenna that the dipole antenna can be provided in a small wireless device.

However, in a case where the dipole antenna DP is provided with such an additional element, the dipole antenna may have strong directivity or significant deterioration of a VSWR property, depending on a shape of the additional element. Accordingly, the shape of the additional element added to the dipole antenna DP should be selected so that the dipole antenna would not have such strong directivity or deterioration of the VSWR property. The dipole antenna described in the following embodiments has a shape selected so that the dipole antenna does not have such disadvantages.

Embodiment 1

Embodiment 1 of the first basic arrangement of the present invention is described below with reference to drawings.

Figure 4:
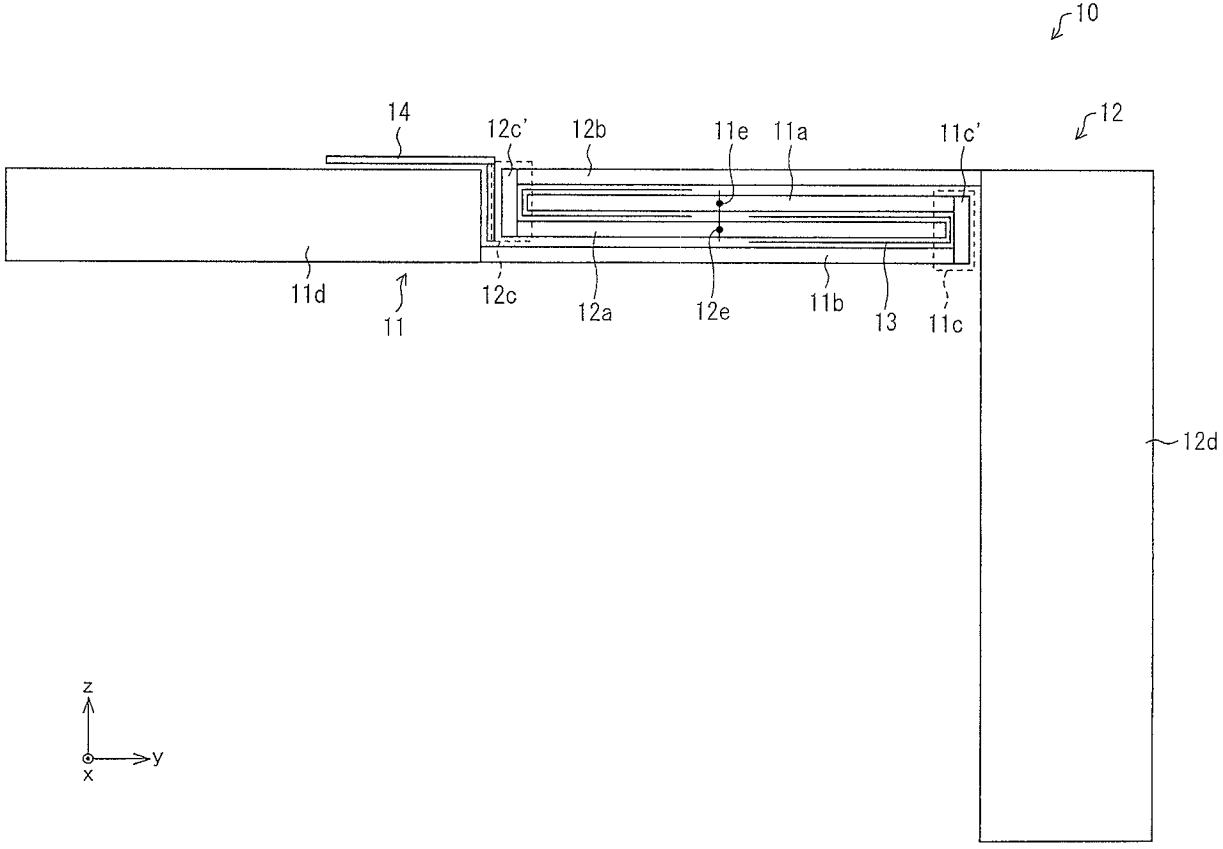
FIG. 4 is a plan view illustrating a structure of the dipole antenna in accordance with Embodiment 1 of the first basic arrangement of the present invention.

FIG. 4 is a plan view illustrating a structure of a dipole antenna 10 in accordance with the present embodiment. The dipole antenna 10 includes an antenna element 11 (first antenna element) and an antenna element 12 (second antenna element), which are arranged on a single plane (y-z plane) (see FIG. 4). Each of the antenna elements 11 and 12 of the dipole antenna 10 of the present embodiment is made of a strip of an electrically conductive film, and is provided on a dielectric sheet (not illustrated).

The antenna element 11 includes a linear section 11*a* (first linear section) extending from one of ends of the antenna element 11 in a plus direction of a y axis (first direction), and a linear section 11*b* (second linear section) being connected to the linear section 11*a* (first linear section) via a bending section 11*c* (first bending section), the linear section 11*b* (second linear section) extending from the bending section 11*c* (first bending section) in a minus direction of the y axis (see FIG. 4). One of ends of the linear section 11*b* (second linear section), being on a side opposite to a bending section 11*c* (first bending section) side, is provided with a wide width section 11*d* (first wide width section) having a width which is greater than that of the linear section 11*b* (see FIG. 4). Electric power is supplied to the antenna element 11 via a feed point 11*e* which is provided on an intermediate part of the linear section 11*a*.

The wide width section 11*d* is an electrically conductive film having a rectangular shape, whose long side is parallel to the direction of the y axis. A length of a short side of the wide width section 11*d*, that is, a width of the wide width section 11*d*, is set to be equal to a distance, in a direction of a z axis, between an outer side of the linear section 11*b* (on a minus direction side of the z axis) and an outer side of the linear section 12*b* (on a plus direction side of the z axis). That is, the width of the wide width section 11*d* is greater than a sum of the widths of four linear sections 11*a*, 11*b*, 12*a*, and 12*b*.

Further, the antenna element 12 includes a linear section 12*a* (third linear section) extending from one of ends of the antenna element 12 in the minus direction of the y axis, and a linear section 12*b* (fourth linear section) being connected to the linear section 12*a* (third linear section) via a bending section 12*c* (second bending section), the linear section 12*b* (fourth linear section) extending from the bending section 12*c* (second bending section) in the plus direction of the y axis (see FIG. 4). One of ends of the linear section 12*b* (fourth linear section), being on a side opposite to a bending section 12*c* (second bending section) side, is provided with a wide width section 12*d* (second wide width section) having a width which is greater than that of the linear section 12*b* (see FIG. 4). Electric power is supplied to the antenna element 12 via a feed point 12*e* which is provided on an intermediate part of the linear section 12*a*.

The wide width section 12*d* is an electrically conductive film having a rectangular shape, whose long side is parallel to the direction of the z axis. A length of a short side of the wide width section 12*d*, that is, a width of the wide width section 12*d*, is set to be not less than that of the wide width section 11*d*.

With the arrangement in which the wide width sections 11*d* and 12*d* are set so that (i) a long side of one of the wide width sections 11*d* and 12*d* is parallel to the direction of the y axis and (ii) a long side of the other one of the wide width sections 11*d* and 12*d* is parallel to the direction of the z axis, it is possible to reduce a size of the dipole antenna in the direction of the y axis, as compared with an arrangement in which long sides of both the wide width sections 11*d* and 12*d* are parallel to the direction of the y axis.

Further, an electrically conductive member 13 is provided in a gap between the linear section 12*a* and the bending section 11*c* so as to adjust, without changing shapes of the antenna elements 11 and 12, a parasitic reactance generated between the antenna elements 11 and 12 (see FIG. 4). The electrically conductive member 13 is such that a line electrically conductive member is bent to have a U shape with no round corner but two square corners. The electrically conductive member 13 is provided so as to (i) be in contact with neither the antenna element 11 nor the antenna element 12 and (ii) surround, on three sides, the one of ends of the linear section 12*a*. It is also possible to provide an electrically conductive member, similar to the electrically conductive member 13, in a gap between the linear section 11*a* and the bending section 12*c*, as illustrated in FIG. 4.

Furthermore, an electrically conductive member 14 is provided in a gap between the bending section 12*c* and the wide width section 11*d* so as to adjust a parasitic capacitance generated between the antenna elements 11 and 12 (see FIG. 4). The electrically conductive member 14 is such that a line electrically conductive member is bent to have an L shape. The electrically conductive member 14 is provided so as to (i) be in contact with neither the antenna element 11 nor the antenna element 12 and (ii) be along (a) a short side of the wide width section 11*d*, which short side faces the bending section 12*c* and (b) a part of a long side of the wide width section 11*d*, which long side intersects with the short side of the wide width section 11*d*. Note that it is possible to provide an electrically conductive member (not illustrated), similar to the electrically conductive member 14, in a gap between the bending section 11*c* and the wide width section 12*d*, instead of providing the electrically conductive member 14 in the gap between the bending section 12*c* and the wide width section 11*d*.

Figure 5:
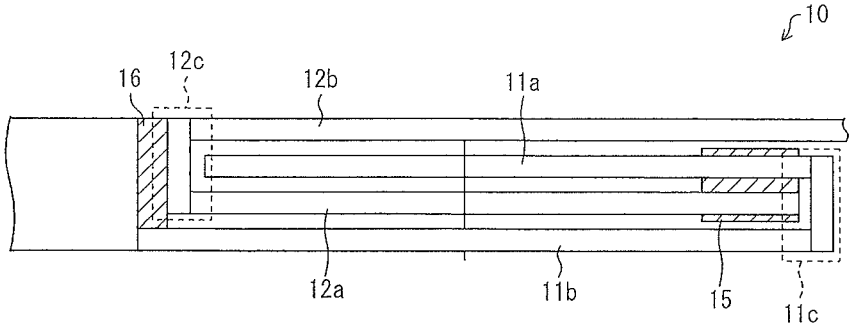
FIG. 5 is an enlarged view illustrating a modified example of the dipole antenna illustrated in FIG. 4 so that a center part of the dipole antenna is shown in an enlarged manner.

Note that, instead of providing the electrically conductive members 13 and 14 to adjust the parasitic reactance and the parasitic capacitance, it is possible to adjust the parasitic reactance and the parasitic capacitance by providing electrically conductive members on a surface of the dielectric sheet, which surface is opposite to the surface on which the antenna elements are provided (see FIG. 5). FIG. 5 is an enlarged view illustrating a center part of the dipole antenna 10. A plate electrically conductive member 15 is provided to cover a part of the gap between the linear section 12*a* and the bending section 11*c*, so as to adjust the parasitic reactance. A plate electrically conductive member 16 is provided to cover a part of the gap between the bending section 12*c* and the wide width section 11*d*, so as to adjust the parasitic capacitance.

Figure 6:
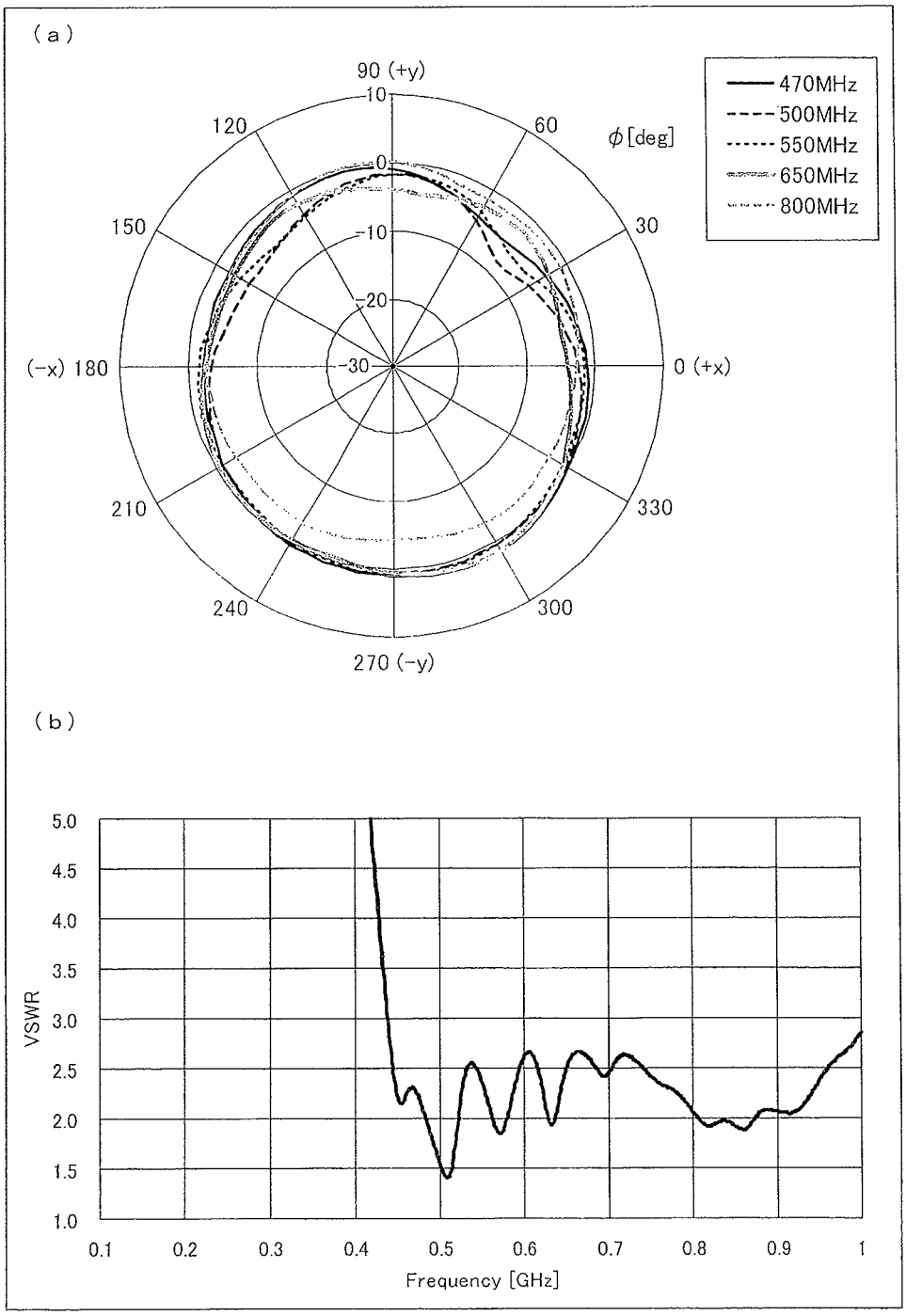
FIG. 6 is a graph showing a property of the dipole antenna illustrated in FIG. 4: (a) of FIG. 6 is a graph showing a radiation pattern; and (b) of FIG. 4 is a graph showing a VSWR property.
Figure 7:
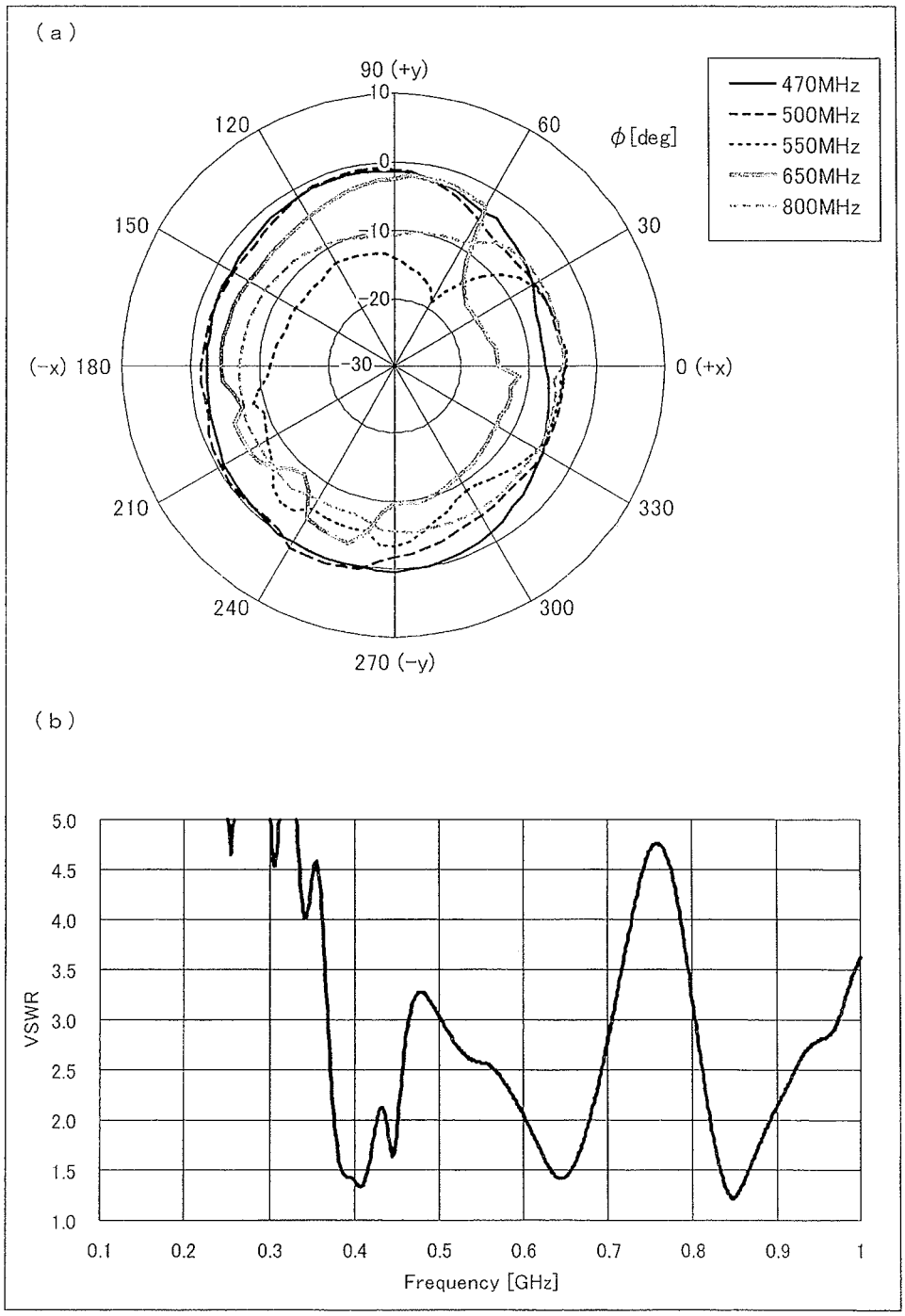
FIG. 7 is a graph showing a property of the dipole antenna illustrated in FIG. 4, in which dipole antenna each section has a size different from that of a corresponding section of the dipole antenna of FIG. 6: (a) of FIG. 7 is a graph showing a radiation pattern; and (b) of FIG. 7 is a graph showing a VSWR property.

Each of FIGS. 6 and 7 shows a property of the dipole antenna 10 thus arranged, particularly, a property of the dipole antenna 10 for a terrestrial digital television bandwidth (not less than 470 MHz but not more than 900 MHz).

(a) of FIG. 6 is a graph showing a radiation pattern of the dipole antenna 10 having the following size, and (b) of FIG. 6 is a graph showing a VSWR property of the dipole antenna 10 having the following size.

Width of linear section 11*a*=2 mm
Width of linear section 12*a*=2 mm
Length of linear section 11*a*=56 mm
Length of linear section 12*a*=56 mm
Width of linear section 11*b*=2 mm
Width of linear section 12*b*=2 mm
Length of linear section 11*b*=60 mm
Length of linear section 12*b*=60 mm
Length of long side of wide width section 11*d*=56 mm
Length of short side of wide width section 11*d*=11 mm
Length of long side of wide width section 12*d*=79 mm
Length of short side of wide width section 12*d*=20 mm As is clear from (a) of FIG. 6, the dipole antenna 10 has no directivity in any direction along an x-y plane through the entire terrestrial digital television bandwidth, even though the dipole antenna 10 has an asymmetric shape. Further, as is clear from (b) of FIG. 6, it is possible to suppress the VSWR to be not more than 3.0 through the entire terrestrial digital television bandwidth.

Meanwhile, (a) of FIG. 7 is a graph showing a radiation pattern of the dipole antenna 10 having the following size, and (b) of FIG. 7 is a graph showing a VSWR property of the dipole antenna having the following size.

Width of linear section 11*a*=2 mm
Width of linear section 12*a*=2 mm
Length of linear section 11*a*=50 mm
Length of linear section 12*a*=50 mm
Width of linear section 11*b*=2 mm
Width of linear section 12*b*=2 mm
Length of linear section 11*b*=54 mm
Length of linear section 12*b*=54 mm
Length of long side of wide width section 11*d*=56 mm
Length of short side of wide width section 11*d*=12 mm
Length of long side of wide width section 12*d*=79 mm
Length of short side of wide width section 12*d*=20 mm As is clear from (a) of FIG. 7, the dipole antenna 10 has no directivity in any direction along the x-y plane in the terrestrial digital television bandwidth (except for a certain part of the terrestrial digital television bandwidth). Further, as is clear from (b) of FIG. 7, it is possible to suppress the VSWR to be not more than 3.0 in the terrestrial digital television bandwidth (except for a bandwidth of not more than 500 MHz and a bandwidth of not less than 700 MHz but not more than 800 MHz).

On the basis of a comparison between the property shown in FIG. 6 and the property shown in FIG. 7, it is clear that the property of the dipole antenna 10 is improved as the length of the each of the linear sections 11*a* and 12*a* (i.e., a distance between the wide width section 11*d* and the wide width section 12*d*) becomes longer.

Note that it was confirmed experimentally that deterioration of the radiation pattern and deterioration of the VSWR property can be suppressed in a higher order mode by causing a length of each of the linear sections 11*a* and 12*a* to be not less than c/(16f) (not less than 1/16 of a corresponding wavelength) (where: f is a frequency within the operation bandwidth, specifically, a lower limit frequency within the operation bandwidth; and c is a velocity of light). Further, it was also confirmed experimentally that deterioration of the radiation pattern and deterioration of the VSWR property can be suppressed in the higher order mode by causing the width of the wide width section 12*d* to be not less than c/(128f) (not less than 1/128 of a corresponding wavelength). Here, the operation bandwidth may be an operation bandwidth predetermined as a spec or a bandwidth defined to satisfy the operation condition that the VSWR is not more than 3.0.

It is assumed that deterioration of the radiation pattern and deterioration of the VSWR property can be suppressed in the higher order mode by causing the width of the wide width section 11*d* to be not less than c/(128f) (not less than 1/128 of a corresponding wavelength), in the same manner as the wide width section 12*d*.

Embodiment 2

The following description deals with Embodiment 2 of the first basic arrangement of the present invention, with reference to drawings.

Figure 8:
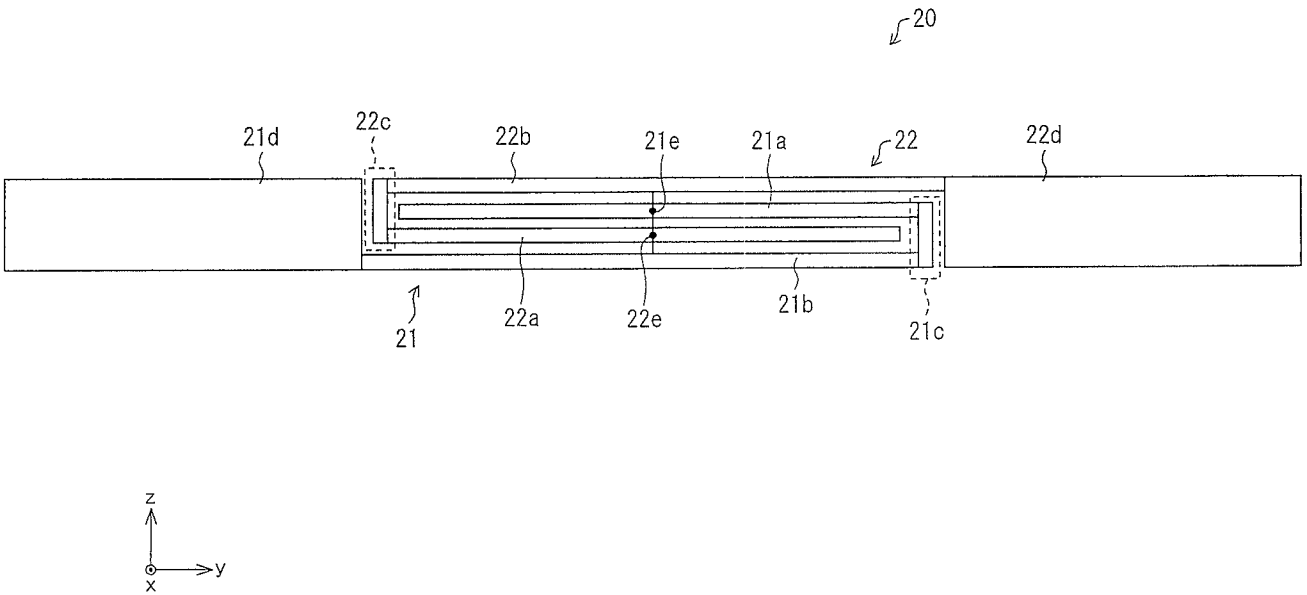
FIG. 8 is a plan view illustrating a structure of a dipole antenna in accordance with Embodiment 2 of the first basic arrangement of the present invention.

FIG. 8 is a plan view illustrating a structure of a dipole antenna 20 of the present embodiment. The dipole antenna 20 includes an antenna element 21 (first antenna element) and an antenna element 22 (second antenna element), which are arranged on a single plane (y-z plane) (see FIG. 8). Each of the antenna elements 21 and 22 of the dipole antenna 20 of the present embodiment is made of a strip of an electrically conductive film, and is provided on a dielectric sheet (not illustrated).

The antenna element 21 includes a linear section 21*a* (first linear section) extending from one of ends of the antenna element 21 in a plus direction of a y axis, a bending section 21*c* (first bending section), and a linear section 21*b* (second linear section) being connected to the linear section 21*a* (first linear section) via the bending section 21*c* (first bending section), the linear section 21*b* (second linear section) extending from the bending section 21*c* (first bending section) in a minus direction of the y axis (see FIG. 8). One of ends of the linear section 21*b*, being on a side opposite to a bending section 21*c* (first bending section) side, is provided with a wide width section 21*d* (first wide width section) having a width which is greater than that of the linear section 21*b* (second linear section) (see FIG. 8). Electric power is supplied to the antenna element 21 via a feed point 21*e* which is provided on an intermediate part of the linear section 21*a*.

The wide width section 21*d* is an electrically conductive film having a rectangular shape, whose long side is parallel to the direction of the y axis. A length of a short side of the wide width section 21*d*, that is, a width of the wide width section 21*d*, is set to be equal to a distance between an outer side of the linear section 21*b* (on a minus direction side of a z axis) and an outer side of the linear section 22*b* (on a plus direction side of the z axis) in the direction of the z axis. That is, the width of the wide width section 21*d* is greater than a sum of widths of four linear sections 21*a*, 21*b*, 22*a*, and 22*b*.

Further, the antenna element 22 includes a linear section 22*a* (third linear section) extending from one of ends of the antenna element 22 in the minus direction of the y axis, and a linear section 22*b* (fourth linear section) being connected to the linear section 22*a* (third linear section) via a bending section 22*c* (second bending section), the linear section 22*b* (second linear section) extending from the bending section 22*c* (second bending section) in the plus direction of the y axis (see FIG. 8). One of ends of the linear section 22*b*, being on a side opposite to a bending section 22*c* (second bending section) side, is provided with a wide width section 22*d* (second wide width section) having a width which is greater than that of the linear section 22*b* (fourth linear section) (see FIG. 8). Electric power is supplied to the antenna element 22 via a feed point 22*e* which is provided on an intermediate part of the linear section 22*a*.

The wide width section 22*d* is an electrically conductive film having a rectangular shape, whose long side is parallel to the direction of the y axis. A length of a short side of the wide width section 22*d*, that is, a width of the wide width section 22*d*, is set to be equal to a distance between an outer side of the linear section 21*b* (on the minus direction side of the z axis) and an outer side of the linear section 22*b* (on the plus direction side of the z axis) in the direction of the z axis. That is, the width of the wide width section 22*d* is greater than a sum of widths of four linear sections 21*a*, 21*b*, 22*a*, and 22*b*. In the example illustrated in FIG. 8, the width of the wide width section 22*d* and the width of the wide width section 21*d* are set to be identical with each other.

With the arrangement in which a long side of each of the wide width sections 21*d* and 22*d* is parallel to the direction of the y axis, it is possible to reduce a size of the antenna element 22 in the direction of the z axis, as compared with an arrangement in which (i) a long side of one of the wide width sections 21*d* and 22*d* is parallel to the direction of the y axis and (ii) a long side of the other one of the wide width sections 21*d* and 22*d* is parallel to the direction of the z axis.

Figure 9:
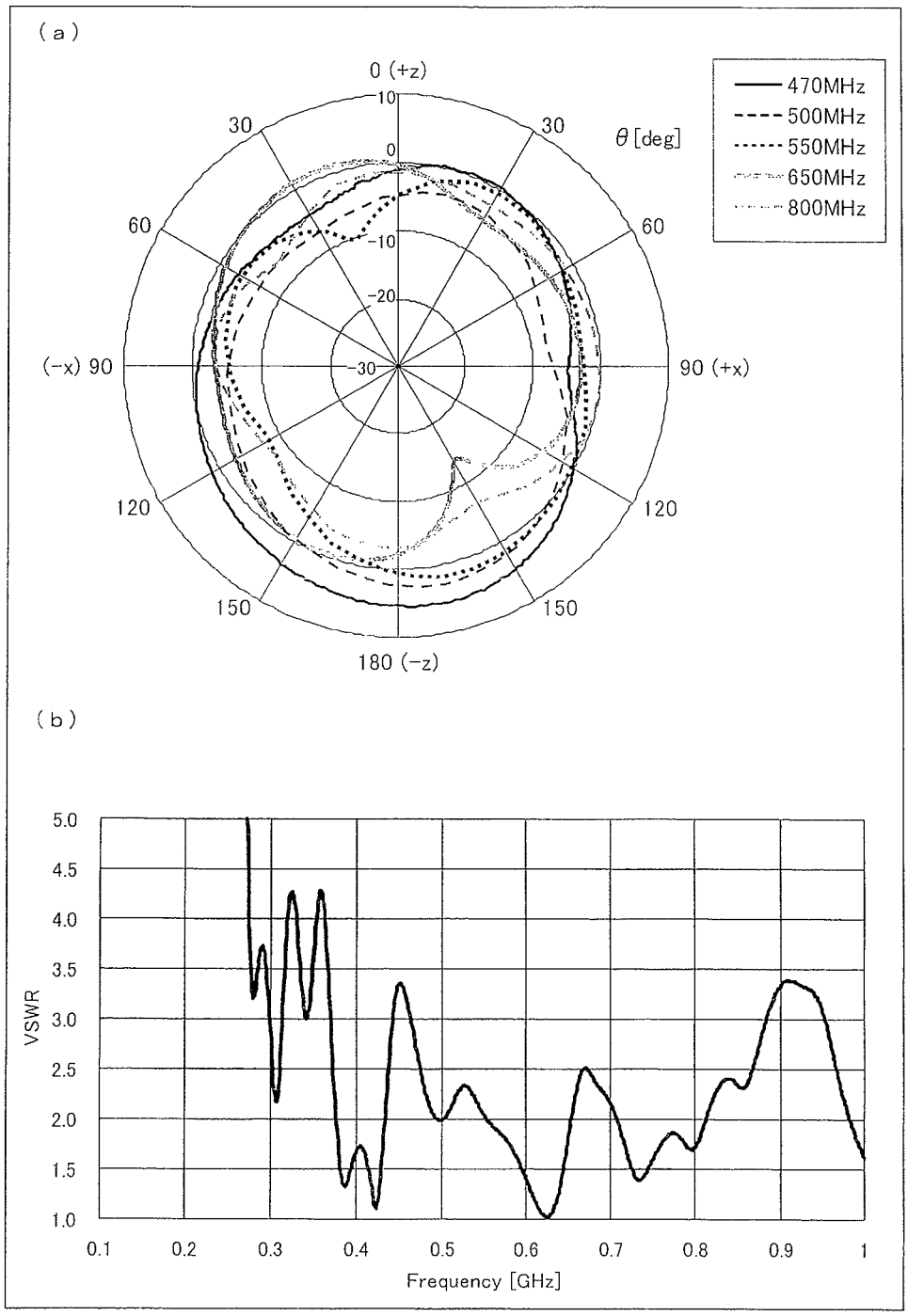
FIG. 9 is a graph showing a property of the dipole antenna illustrated in FIG. 8: (a) of FIG. 9 is a graph showing a radiation pattern; and (b) of FIG. 9 is a VSWR property.
Figure 10:
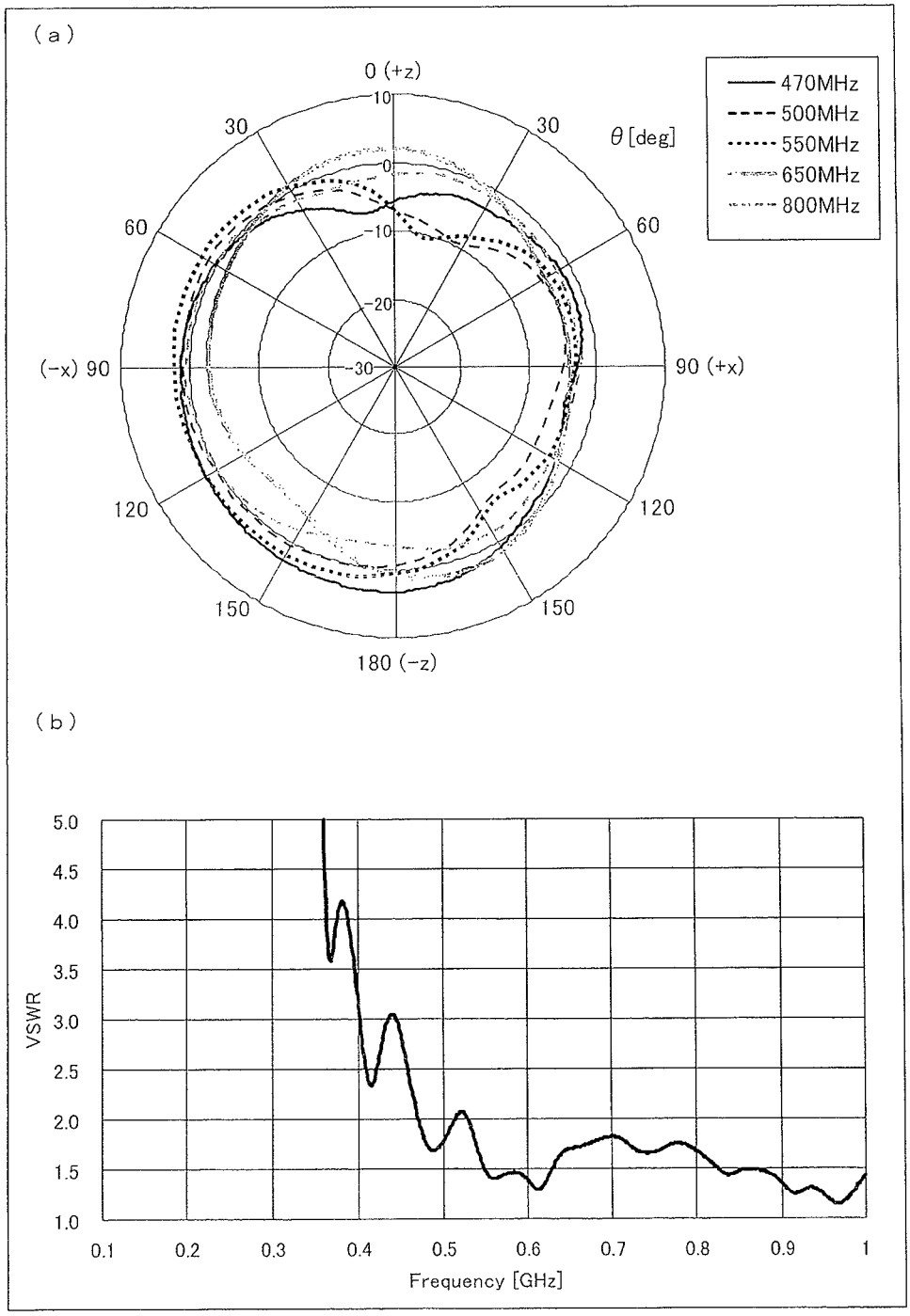
FIG. 10 is a graph showing a property of the dipole antenna illustrated in FIG. 8, in which dipole antenna each section has a size different from that of a corresponding section of the dipole antenna of FIG. 9: (a) of FIG. 10 is a graph showing a radiation pattern; and (b) of FIG. 10 is a graph showing a VSWR property.

Each of FIGS. 9 and 10 shows a property of the dipole antenna 20 thus arranged, specifically, the dipole antenna for a terrestrial digital television bandwidth (not less than 470 MHz but not more than 900 MHz).

(a) of FIG. 9 shows a radiation pattern of the dipole antenna 20 having the following size, and (b) of FIG. 9 is a graph showing a VSWR property of the dipole antenna 20 having the following size.

Width of linear section 21*a*=2 mm
Width of linear section 22*a*=2 mm
Length of linear section 21*a*=82 mm
Length of linear section 22*a*=82 mm
Width of linear section 21*b*=2 mm
Width of linear section 22*b*=2 mm
Length of linear section 21*b*=88 mm
Length of linear section 22*b*=88 mm
Length of long side of wide width section 21*d*=56 mm
Length of short side of wide width section 21*d*=14 mm
Length of long side of wide width section 22*d*=57 mm
Length of short side of wide width section 22*d*=14 mm As is clear from (a) of FIG. 9, the dipole antenna 20 has no directivity in any direction along an x-z plane within the terrestrial digital television bandwidth (except for a certain part of the terrestrial digital television bandwidth). Further, as is clear from (b) of FIG. 9, it is possible to suppress the VSWR to be not more than 3.0 within the terrestrial digital television bandwidth (except for a bandwidth in the vicinity of 450 MHz and a bandwidth of not less than 850 MHz).

Meanwhile, (a) of FIG. 10 shows a radiation pattern of the dipole antenna 20 having the following size, and (b) of FIG. 10 is a graph showing a VSWR property of the dipole antenna 20 having the following size.

Width of linear section 21*a*=2 mm
Width of linear section 22*a*=2 mm
Length of linear section 21*a*=82 mm
Length of linear section 22*a*=82 mm
Width of linear section 21*b*=2 mm
Width of linear section 22*b*=2 mm
Length of linear section 21*b*=88 mm
Length of linear section 22*b*=88 mm
Length of a long side of wide width section 21*d*=56 mm
Length of short side of wide width section 21*d*=14 mm
Length of long side of wide width section 22*d*=56 mm
Length of short side of wide width section 22*d*=14 mm As is clear from (a) of FIG. 10, the dipole antenna 20 has substantially no directivity in any direction along the x-z plane through the entire terrestrial digital television bandwidth. Further, as is clear from (b) of FIG. 10, it is possible to suppress the VSWR to be not more than 3.0 through the entire terrestrial digital television bandwidth.

Note that it was confirmed experimentally that deterioration of the radiation pattern and deterioration of the VSWR property can be suppressed in a higher order mode by causing the width of the wide width section 22*d* to be not less than c/(128f) (not less than 1/128 of a corresponding wavelength) (where: f is a frequency within an operation bandwidth, more specifically, a lower limit of the operation bandwidth when the operation bandwidth is defined as a bandwidth satisfying an operation condition that the VSWR is not more than 3.0; and c is a velocity of light).

[Second Basic Arrangement of the Present Invention]

Figure 11:
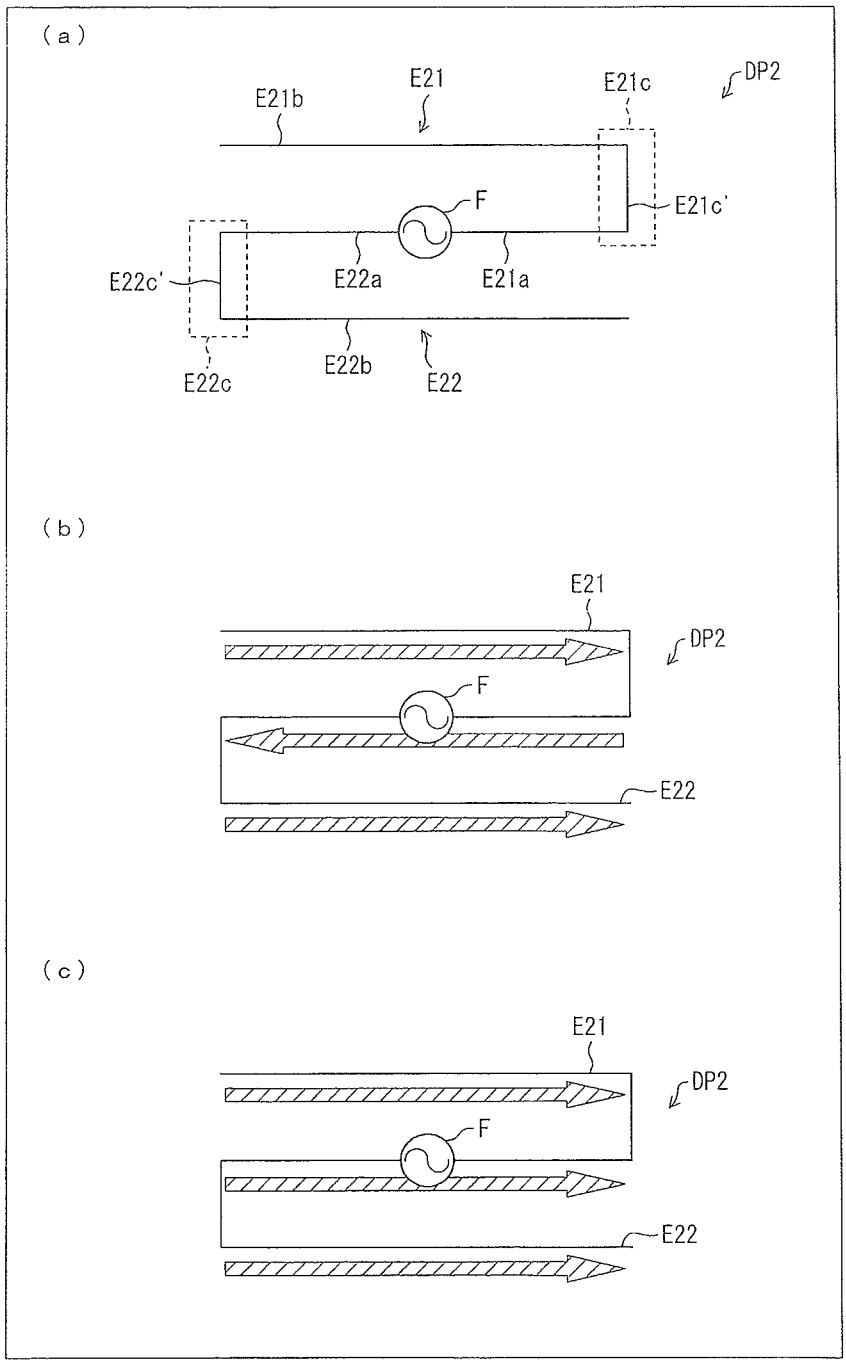
FIG. 11 is an explanatory view illustrating a dipole antenna of a second basic arrangement of the present invention: (a) of FIG. 11 is a view illustrating a structure of the dipole antenna of the second basic arrangement of the present invention; (b) of FIG. 11 is a view illustrating current distribution of the dipole antenna at a first resonance frequency; and (c) of FIG. 11 is a view illustrating current distribution of the dipole antenna at a second resonance frequency.

First, the following description deals with a second basic arrangement of the present invention, with reference to FIG. 11, which second basic arrangement is a basic arrangement for the following specific embodiments. Then, specific embodiments of the second basic arrangement of the present invention are described.

(a) of FIG. 11 is a view illustrating a structure of a dipole antenna DP2 of the present invention. The dipole antenna DP2 of the present invention includes an antenna element E21 and an antenna element E22, which are arranged on a single plane (see (a) of FIG. 11).

The antenna element E21 includes a linear section E21*a* (first linear section) extending from a feed point F in a first direction, and a linear section E21*b* (second linear section) being connected to the linear section E21*a* (first linear section) via a bending section E21*c* (first bending section), the linear section E21*b* (second linear section) extending from the bending section E21*c* (first bending section) in a direction opposite to the first direction (see (a) of FIG. 11).

Further, the antenna element E22 includes a linear section E22*a* (third linear section) extending from the feed point F in the direction opposite to the first direction, and a linear section E22*b* (fourth linear section) being connected to the linear section E22*a* (third linear section) via a bending section E22*c* (second bending section), the linear section E22*b* extending from the bending section E22*c* in the first direction (see (a) of FIG. 11).

That is, the dipole antenna DP2 of the present invention is such that (i) the antenna element E21 is such a bent element that the linear sections E21*a* and E21*b*, adjacent to each other via the bending section E21*c*, are parallel to each other, (ii) the antenna element E22 is such a bent element that the linear sections E22*a* and E22*b*, adjacent to each other via the bending section E22*c*, are parallel to each other, (iii) the antenna elements E21 and E22 are arranged to have point symmetry with respect to the feed point F, and (iv) one of end points of the antenna element E21 and one of end points of the antenna element E22, which face each other via the feed point F, are connected to a feed line (not illustrated).

The dipole antenna DP2 illustrated in (a) of FIG. 11 employs the bending section E21*c* constituted by straight line parts (more specifically, a U shape with no round corner but two square corners), namely, (i) one of end sections of the linear section E21*a*, which is the one farther from the feed point F, (ii) one of end sections of the linear section E21*b*, which is the one closer to the feed point F (when the antenna element E21 is caused to stretch as a single straight line), and (iii) a linear section E21*c*' which extends in a direction perpendicular to the first direction. Note, however, that the present invention is not limited to this, and it is possible to employ a bending section constituted by a curved line part (e.g., a U shape with a round corner), in place of the bending section E21*c* constituted by the straight line parts. This also applies to the bending section E22*c* of the antenna element E22. Note that the one of end sections of the linear section E21*a*, farther from the feed point F, is an end section (in the vicinity of an end point) on a premise that an intersection between the linear section E21*a* and the linear section E21*c*' serves as the end point. Further, the one of end sections of the linear section E21*b*, closer to the feed point F, is an end section (in the vicinity of an end point) on a premise that an intersection between the linear section E21*b* and the linear section E21*c*' serves as the end point.

With the arrangement employing the antenna elements E21 and E22 thus bent (see (a) of FIG. 11), it is possible to widen the operation bandwidth of the dipole antenna DP2, as compared with a conventional arrangement in which the antenna elements E21 and E22 are not bent. The following description deals with the reason why such an advantage is achieved, with reference to FIG. 11.

That is, with the arrangement employing the antenna elements E21 and E22 thus bent (see (a) of FIG. 11), it is possible to cause a direction in which a current flows through the antenna element E21 at a second resonance frequency f2 and a direction in which a current flows through the antenna element E22 at the second resonance frequency f2 to be identical with each other (see (c) of FIG. 11). This shifts the second resonance frequency f2 toward a low-frequency side. That is, it is possible to cause the radiation pattern at the second resonance frequency f2 to be a single-peaked radiation pattern.

Such a single-peaked radiation pattern at the second resonance frequency f2 means that the second resonance frequency f2 is shifted toward the low frequency side with respect to a frequency $f_{G0max}$ at which a radiant gain $G_0$ shows a local maximum value, that is, there is no sharp reduction in radiant gain $G_0$ between the first resonance frequency f1 and the second resonance frequency f2. Accordingly, it becomes possible to use, as an operation bandwidth satisfying an operation condition set with respect to the radiant gain $G_0$, a bandwidth in the vicinity of the second resonance frequency f2, which bandwidth could not be used as the operation bandwidth with a conventional arrangement, due to a sharp reduction in radiant gain $G_0$.

In addition, with the arrangement employing the antenna elements E21 and E22 thus bent (see (a) of FIG. 11), it becomes possible to realize a further wider operation bandwidth. That is, in a case where the second resonance frequency f2 is shifted toward the low-frequency side, the first resonance frequency f1 and the second resonance frequency f2 become closer to each other. In this case, an input reflection coefficient $S_{1,1}$ is reduced through an entire bandwidth between the first resonance frequency f1 and the second resonance frequency f2. Moreover, there is no sharp reduction in radiant gain $G_0$ between the first resonance frequency f1 and the second resonance frequency f2, as described above. Accordingly, depending on an operation condition set with respect to the input reflection coefficient $S_{1,1}$, it is possible to use the entire bandwidth between the first resonance frequency f1 and the second resonance frequency f2 as the operation bandwidth.

In (a) of FIG. 11, L21*b* (a length of the linear section E21*b*), L22*b* (a length of the linear section E22*b*), and a sum of L21*a* (a length of the linear section E21*a*) and L22*a* (a length of the linear section E22*a*) (L21*a*+L22*a*) are identical with each other. Note, however, that this is not an essential condition for causing the operation bandwidth to be wider. That is, either in a case where an inequality of "L21*b* (=L22*b*)>L21*a*+L22*a*" is satisfied, or in a case where an inequality of "L21*b* (=L22*b*) <L21*a*+L22*a*" is satisfied, the radiation pattern at the second resonance frequency f2 becomes a single-peaked radiation pattern. That is, since the second resonance frequency f2 becomes lower than a frequency $f_{G0max}$ at which the radiant gain $G_0$ shows a local maximum value, it is possible to achieve an effect of causing the operation bandwidth to be wider.

Note, however, that, as illustrated in (b) of FIG. 11, at the first resonance frequency f1, the direction in which the current flows through the antenna element E21 and the direction in which the current flows through the antenna element E22 are caused to be different from each other in a space. In this case, the radiant gain $G_0$ could be reduced in the vicinity of the first resonance frequency f1. This is because a part of an electromagnetic wave radiated from the linear section E21*b* and a part of an electromagnetic wave radiated from the linear section E22*b* are cancelled with, respectively, electromagnetic waves radiated from the respective linear sections E21*a* and E22*a*.

Figure 12:
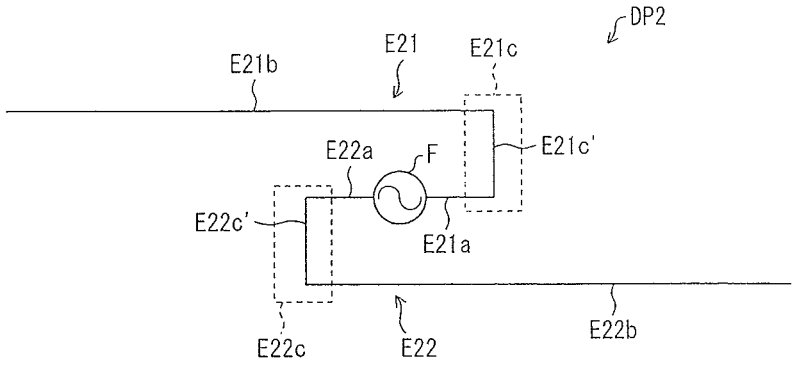
FIG. 12 is a view illustrating a preferable modified example of the dipole antenna illustrated in (a) of FIG. 11.

For this reason, in the following embodiments, in order to reduce a proportion of parts of the electromagnetic waves radiated from the respective linear sections E21*b* and E22*b*, which parts are cancelled with the electromagnetic waves radiated from the respective linear sections E21*a* and E22*a*, both L21*b* (a length of the linear section E21*b*) and L22*b* (a length of the linear section E22*b*) are set to be longer than L21*a*+L22*a* (a sum of a length of the linear section E21*a* and a length of the linear section E22*a*) (see FIG. 12). In other words, in a case where the antenna elements E21 and E22 are arranged to have point symmetry with respect to the feed point F, the lengths of the linear sections are set to satisfy an inequality of L21*a*/L21*b*<0.5. This makes it possible to suppress a reduction in radiant gain $G_0$, which reduction could be caused in the vicinity of the first resonance frequency f1.

Embodiment 1

Embodiment 1 of the second basic arrangement of the present invention is described below with reference to drawings.

Figure 13:
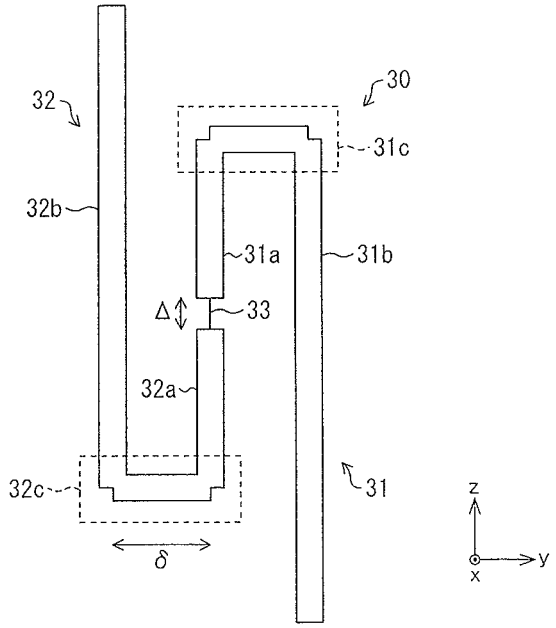
FIG. 13 is a plan view illustrating a structure of a dipole antenna in accordance with Embodiment 1 of the second basic arrangement of the present invention.

FIG. 13 is a plan view illustrating a structure of a dipole antenna 30 of the present embodiment. The dipole antenna 30 includes an antenna element 31 and an antenna element 32, which are arranged on a single plane (y-z plane) (see FIG. 13). Each of the antenna elements 31 and 32 of the dipole antenna 30 of the present embodiment is made of an electrically conductive wire, more specifically, made of an electrically conductive wire having a radius of 1 mm.

The antenna element 31 includes a linear section 31*a* extending from a feed point 33 in a plus direction of a z axis, and a linear section 31*b* being connected to the linear section 31*a* via a bending section 31*c*, the linear section 31*b* extending from the bending section 31*c* in a minus direction of the z axis. The antenna element 31 terminates at one of end points of the linear section 31*b* which one of end points is on a side opposite to a bending section 31*c* side. That is, the antenna element 31 is constituted by the linear section 31*a*, the linear section 31*b*, and the bending section 31*c*, and has no component on the side opposite to the bending section 31*c* side with respect to the one of end points of the linear section 31*b*.

Further, the antenna element 32 includes a linear section 32*a* extending from the feed point 33 in the minus direction of the z axis, and a linear section 32*b* being connected to the linear section 32*a* via a bending section 32*c*, the linear section 32*b* extending from the bending section 32*c* in the plus direction of the z axis. The antenna element 32 terminates at one of end points of the linear section 32*b* which one of end points is on a side opposite to a bending section 32*c* side. That is, the antenna element 32 is constituted by the linear section 32*a*, the linear section 32*b*, and the bending section 32*c*, and has no component on the side opposite to the bending section 32*c* side with respect to the one of end points of the linear section 32*b*.

Further, each section of the dipole antenna 30 of the present embodiment has the following size.

Figure 14:
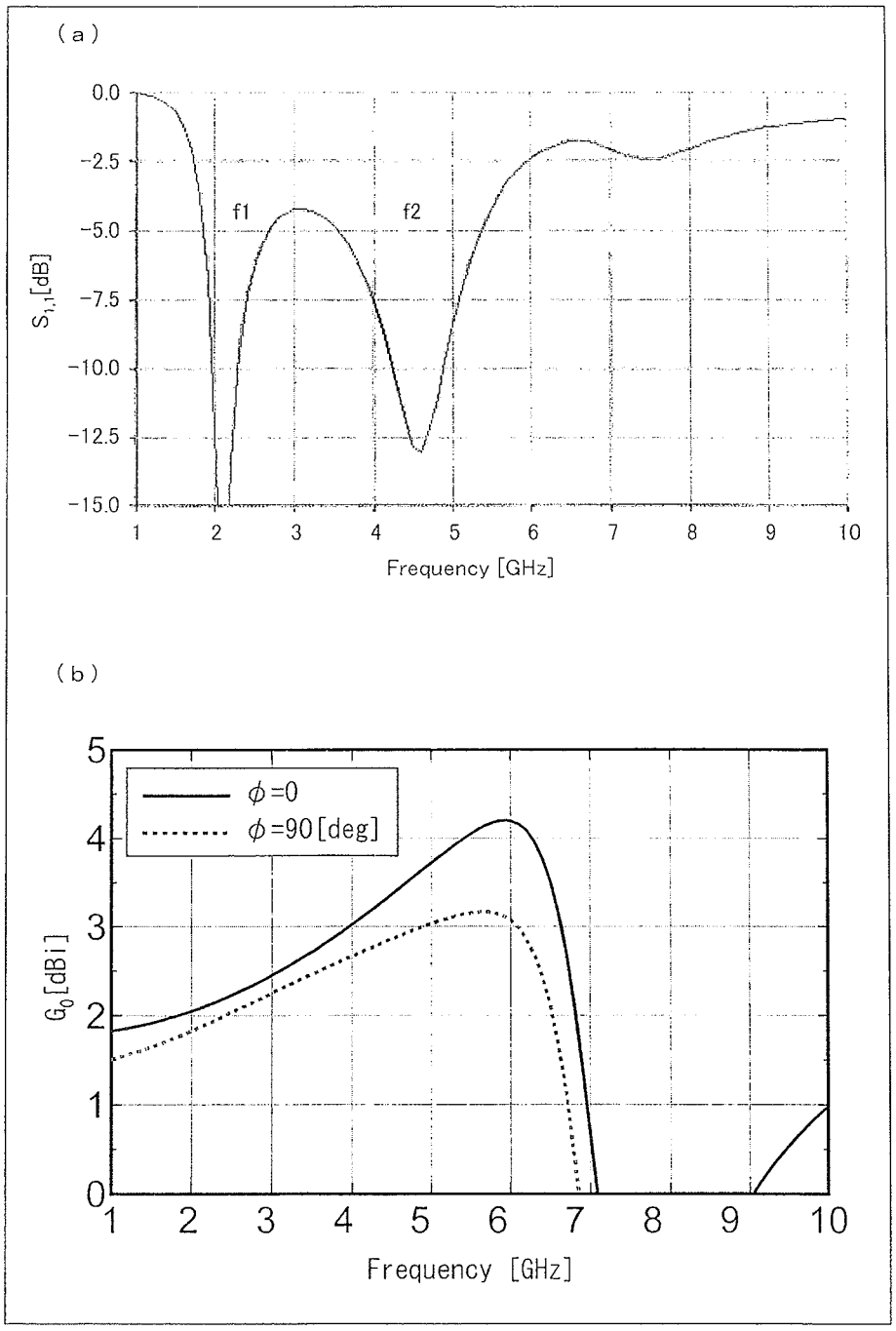
FIG. 14 is a graph showing a property of the dipole antenna illustrated in FIG. 13: (a) of FIG. 14 is a graph showing frequency dependency of an input reflection coefficient; and (b) of FIG. 14 is a graph showing frequency dependency of a radiant gain.

L31*a* (length of linear section 31*a*)=L32*a* (length of linear section 32*a*)=3 mm L31*b* (length of linear section 31*b*)=L32*b* (length of linear section 32*b*)=34 mm Gap Δ between antenna elements 31 and 32 facing each other via feed point 33=2 mm Distance δ between center axis of linear section 31*a* and center axis of linear section 31*b*=distance δ between center axis of linear section 32*a* and center axis of linear section 32*b*=3 mm FIG. 14 shows properties of the dipole antenna 30 thus arranged. (a) of FIG. 14 shows frequency dependency of an input reflection coefficient $S_{1,1}$, and (b) of FIG. 14 shows frequency dependency of a radiant gain $G_0$. Note that the dipole antenna 30 has no axial symmetry. For this reason, (b) of FIG. 14 shows a radiant gain $G_0$ on a condition of θ=90° and ϕ=0°, and a radiant gain $G_0$ on a condition of θ=90° and ϕ=90° (θ indicates a deflection angle with respect to the z axis in a polar coordinate system, and ϕ indicates a deflection angle with respect to an x axis in the polar coordinate system).

As is clear from (a) of FIG. 14, the dipole antenna 30 of the present embodiment has a first resonance frequency f1 of 2.1 GHz and a second resonance frequency f2 of 4.6 GHz. For example, in a case where an operation condition of $|S_{1,1}| \leq -5.1$ dB is set with respect to the input reflection coefficient $S_{1,1}$, the operation bandwidth is constituted by a bandwidth of not less than 1.9 GHz but not more than 2.7 GHz (fractional bandwidth: 35%) and a bandwidth of not less than 3.5 GHz but not more than 5.3 GHz (fractional bandwidth: 40%).

Further, as is clear from (b) of FIG. 14, since the second resonance frequency f2 is shifted toward a low-frequency side with respect to a frequency $f_{G0max}$ at which the radiant gain $G_0$ shows a local maximum value, the radiant gain $G_0$ increases monotonically until the frequency reaches a frequency of 6.0 GHz ($f_{G0max}$=6.0 GHz) which is higher than the second resonance frequency f2. Accordingly, for example, even if an operation condition is set with respect to the radiant gain $G_0$ so that the radiant gain $G_0$ is not less than 2 dBi, it is possible to use, as the operation bandwidth, an entire bandwidth (not less than 1.9 GHz but not more than 2.7 GHz) in the vicinity of the first resonance frequency f1 and an entire band width (not less than 3.5 GHz but not more than 5.3 GHz) in the vicinity of the second resonance frequency f2, both of which satisfy the operation condition set with respect to the input reflection coefficient $S_{1,1}$.

Furthermore, for example, in a case where the operation condition is set with respect to the input reflection coefficient $S_{1,1}$ so as to satisfy $|S_{1,1}| \leq -4.3$ dB, it is possible to use, as the operation bandwidth, a bandwidth of not less than 1.8 GHz but not more than 5.5 GHz, including the first resonance frequency f1 and the second resonance frequency f2. The reason why the bandwidth between the first resonance frequency f1 and the second resonance frequency f2 can be used as the operation bandwidth as described above is that (i) the input reflection coefficient $S_{1,1}$ is reduced through the entire bandwidth between the first resonance frequency f1 and the second resonance frequency f2 as the first resonance frequency f1 and the second resonance frequency become closer to each other (see (a) of FIG. 14), and (ii) the second resonance frequency f2 (4.6 GHz) is shifted toward the low-frequency side with respect to the frequency $f_{G0max}$ (6.0 GHz) at which the radiant gain $G_0$ shows a local maximum value, so that there is no risk of a sharp reduction in radiant gain $G_0$ between the first resonance frequency f1 and the second resonance frequency f2 (see (b) of FIG. 14).

Figure 15:
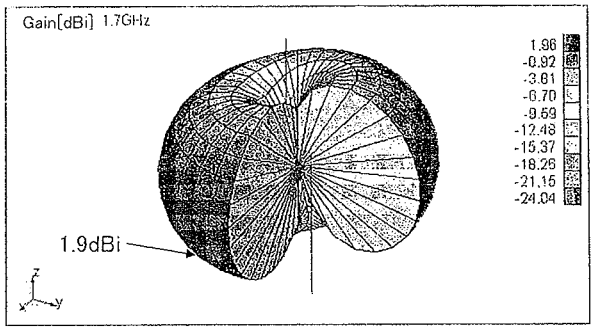
FIG. 15 is a graph showing a radiation pattern of the dipole antenna illustrated in FIG. 13: (a) of FIG. 15 shows a radiation pattern at a frequency of 1.7 GHz; (b) of FIG. 15 shows a radiation pattern at a frequency of 3.4 GHz; and (c) of FIG. 15 is a radiation pattern at a frequency of 5.1 GHz.
Figure 15:
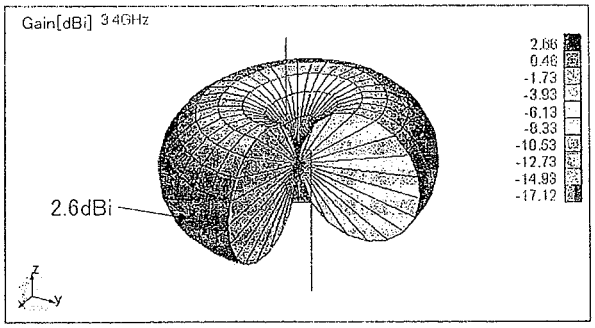
Figure 15:
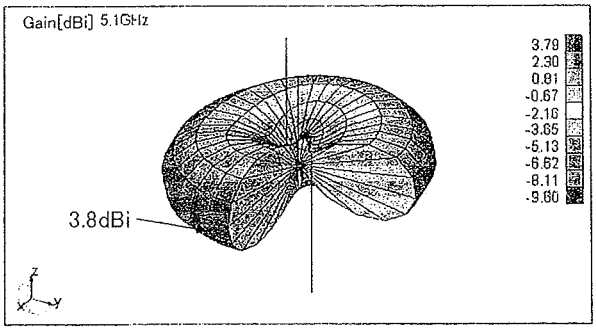
Figure 16:
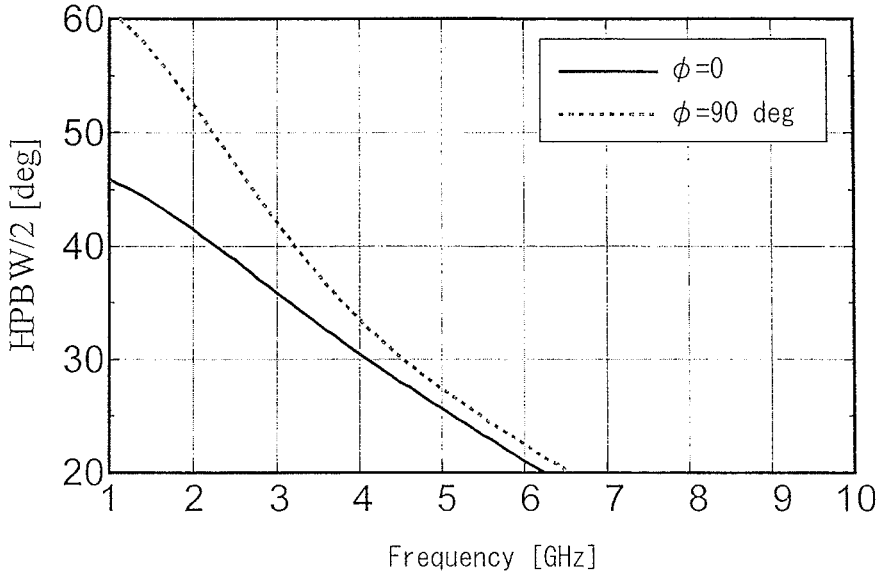
FIG. 16 is a graph showing frequency dependency of an HPBW of the dipole antenna illustrated in FIG. 13.

FIG. 15 shows frequency dependency of a radiation pattern, and FIG. 16 shows frequency dependency of HPBW/2. On the basis of FIGS. 15 and 16, it is also confirmed that the frequency $f_{G0max}$ (6.0 GHz) at which the radiant gain $G_0$ shows a local maximum value is increased to be more than the second resonance frequency f2, that is, a sufficiently high radiant gain $G_0$ can be obtained in the vicinity of the second resonance frequency f2 without a sharp reduction in radiant gain $G_0$ between the first resonance frequency f1 and the second resonance frequency f2.

(a) of FIG. 15 shows a radiation pattern at a frequency of 1.7 GHz, (b) of FIG. 15 shows a radiation pattern at a frequency of 3.4 GHz, and (c) of FIG. 15 shows a radiation pattern at a frequency of 5.1 GHz. By comparing (a), (b), and (c) of FIG. 15 one another, it becomes clear that (i), at least in a bandwidth of not more than 5.1 GHz, the radiation pattern is gradually concentrated in a direction of θ=90° while keeping a single-peaked shape, and, simultaneously, (ii) the radiant gain $G_0$ in the direction of θ=90° is also gradually increased.

Further, in FIG. 16, a solid line indicates frequency dependency of HPBW/2 in a direction defined by θ=90° and ϕ=0°, and a dotted line indicates frequency dependency of HPBW/2 in a direction defined by θ=90° and ϕ=90°. On the basis of FIG. 16, it becomes clear that, in a bandwidth of not more than 6.0 GHz, the radiation pattern is gradually concentrated in the direction of θ=90° while keeping a single-peaked shape, regardless of ϕ.

Modified Example

By setting each section of the structure illustrated in FIG. 13 to have the following size, it becomes possible to realize the dipole antenna 30 whose first resonance frequency f1 and second resonance frequency f2 are significantly close to each other. Note that, in the present modified example, each of the antenna elements 31 and 32 is constituted by an electrically conductive wire having a radius of 1 mm.

Figure 17:
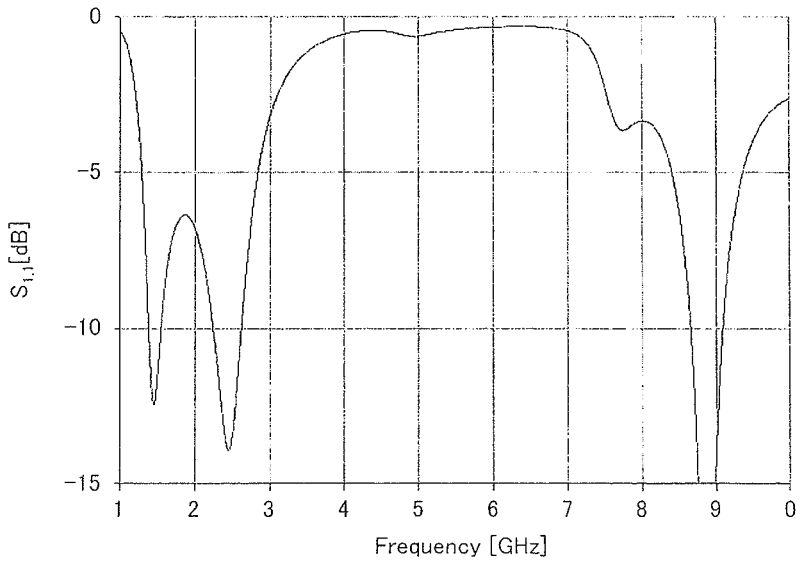
FIG. 17 is a graph showing frequency dependency of an input reflection coefficient of the dipole antenna illustrated in FIG. 13, in which dipole antenna each section has a size different from that of a corresponding section of the dipole antenna of (a) of FIG. 14.

L31*a* (length of linear section 31*a*)=L32*a* (length of linear section 32*a*)=10 mm L31*b* (length of linear section 31*b*)=L32*b* (length of linear section 32*b*)=55 mm Gap Δ between antenna elements 31 and 32 facing each other via feed point 33=2 mm Distance δ between center axis of linear section 31*a* and center axis of linear section 31*b*=distance δ between center axis of linear section 32*a* and center axis of linear section 32*b*=3 mm FIG. 17 shows frequency dependency of an input reflection coefficient $S_{1,1}$ of the dipole antenna 30 of the present modified example. The first resonance frequency f1 and the second resonance frequency f2 are significantly close to each other, and a deep valley of the input reflection coefficient $S_{1,1}$ is formed in a bandwidth including the first resonance frequency f1 and the second resonance frequency f2. For this reason, for example, even if an operation condition of $|S_{1,1}| \leq -4.3$ dB is set with respect to the input reflection coefficient $S_{1,1}$, it is possible to realize a wide operation bandwidth of not less than 1.3 GHz but not more than 2.8 GHz (fractional bandwidth: 73%).

Figure 18:
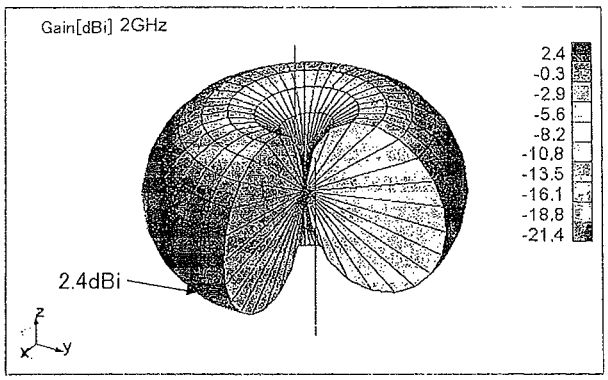
FIG. 18 is a graph showing a radiation pattern of the dipole antenna illustrated in FIG. 13, in which dipole antenna each section has a size that is identical with that of a corresponding section of the dipole antenna of FIG. 17.

FIG. 18 shows a radiation pattern of the dipole antenna 30 of the present modified example at a frequency of 2.0 GHz. As shown in FIG. 18, according to the dipole antenna 30 of the present modified example, at least in the vicinity of a frequency of 2.0 GHz, it is possible to (i) obtain a radiation pattern having significantly high axial symmetry similar to that of a conventional λ/2 dipole antenna, and simultaneously, (ii) obtain a sufficiently high radiant gain $G_0$ (2.4 dBi).

(Geometric Effect)

Next, the following description deals with a geometric effect of the dipole antenna 30 of the present embodiment. A shape of the dipole antenna 30 of the present embodiment can be defined by three parameters, namely, h1 (=L31*a*=L32*a*), h2 (=L31*b*=L32*b*), and w (=δ≈L31*c*'=L32*c*'), on a premise that the dipole antenna 30 has point symmetry with respect to the feed point 33. Further, by not taking into account its scale, it is possible to define the shape of the dipole antenna 30 by use of two parameters, namely, h1/h2 and w/h2. The following description deals with how the resonance frequencies change as these two parameters are changed.

Figure 19:
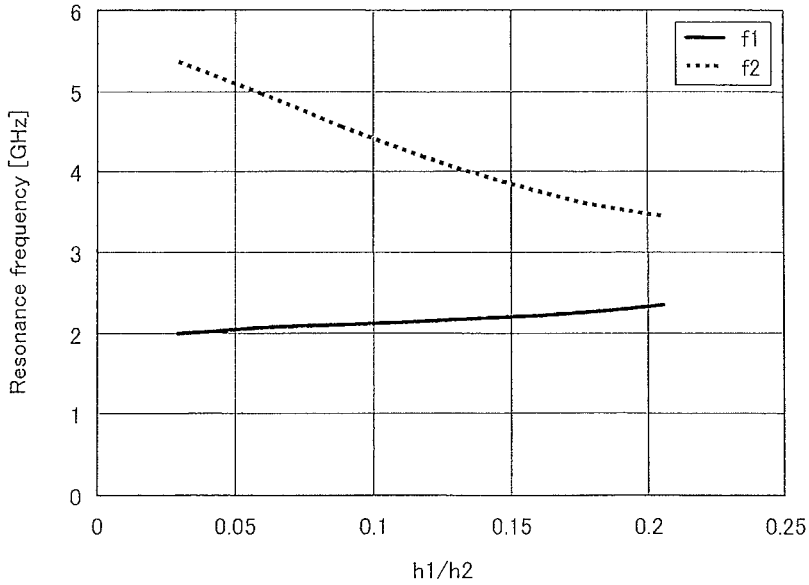
FIG. 19 is a graph showing geometry parameter dependency of a resonance frequency of the dipole antenna illustrated in FIG. 13.

FIG. 19 is a graph showing how the first resonance frequency f1 and the second resonance frequency f2 change as h1/h2 is changed. Note that the graph is obtained on a condition where each section of the dipole antenna 30 has the following size. Here, each of the antenna elements 31 and 32 is constituted by an electrically conductive wire having a radius of 1 mm.

L31*a* (length of linear section 31*a*)=L32*a* (length of linear section 32*a*)=h1 (variable)

L31*b* (length of linear section 31*b*)=L32*b* (length of linear section 32*b*)=h2=34 mm (fixed)

Gap Δ between antenna elements 31 and 32 facing each other via feed point 33=2 mm (fixed)

Distance δ between center axis of linear section 31*a* and center axis of linear section 31*b*=distance δ between center axis of linear section 32*a* and center axis of linear section 32*b*=3 mm (fixed)

As a value of h1/h2 is increased, that is, the linear section 31*a*, closer to the feed point 33, is caused to be greater in length, the second resonance frequency f2 is shifted toward a low-frequency side, and the first resonance frequency f1 is shifted toward a high-frequency side (see FIG. 19). In FIG. 19, the graph is not shown with h1/h2 of more than approximately 0.2. This is because, the first resonance frequency f1 and the second resonance frequency f2 becomes significantly close to each other so that they cannot be identified on the basis of the input reflection coefficient $S_{1,1}$.

It should be noted, in FIG. 19, that the second resonance frequency f2 becomes close to the first resonance frequency f1 successfully and certainly when h1/h2 is at least in a range of not less than 0.05 but not more than 0.2. As the second resonance frequency f2 becomes close to the first resonance frequency f1, the input reflection coefficient $S_{1,1}$ is reduced in the vicinity of a frequency on a low-frequency side with respect to the second resonance frequency f2. Accordingly, in a case where h1/h2 is not less than 0.05 but not more than 0.2, it is possible to obtain an effect of causing the operation bandwidth in the vicinity of the second resonance frequency to be greater successfully and certainly.

Further, in a case where h1/h2 is not less than 0.2, the first resonance frequency f1 and the second resonance frequency f2 become significantly close to each other (it is impossible to identify them on the basis of the input reflection coefficient $S_{1,1}$, that is, the first resonance frequency f1 and the second resonance frequency f2 become integral with each other). Since a valley of the input reflection coefficient $S_{1,1}$ is formed in a bandwidth between the first resonance frequency f1 and the second resonance frequency f2, it is possible to use, as the operation bandwidth, the entire bandwidth between the first resonance frequency f1 and the second resonance frequency f2. By extrapolating a graph, it can be confirmed that such an effect can be obtained in a case where h1/h2 is at least not more than 0.3. Accordingly, in a case where h1/h2 is not less than 0.05 but not more than 0.3, it is possible to cause the operation bandwidth to be greater successfully.

Furthermore, by referring to the graph shown in FIG. 19, it is possible to design easily the dipole antenna 30 having a desired operation bandwidth. For example, in a case where a bandwidth of 5 GHz and a bandwidth of 2 GHz are desired as the operation bandwidth, the antenna elements 31 and 32 should have such shapes that h1/h2 is approximately 0.05. In a case where a wide bandwidth of not less than 2.5 GHz but not more than 3.5 GHz is desired as the operation bandwidth, the antenna elements 31 and 32 should have such shapes that h1/h2 is approximately 0.2.

Figure 20:
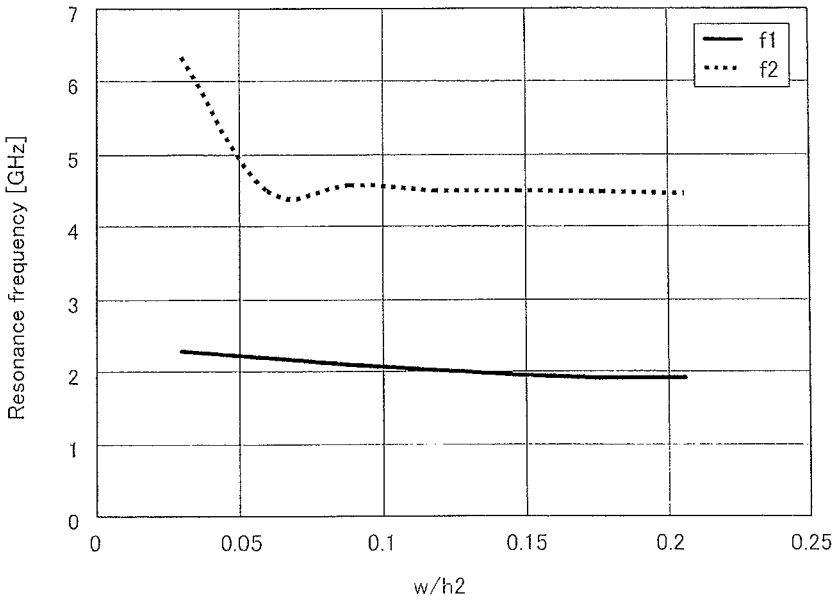
FIG. 20 is a graph showing geometry parameter dependency of a resonance frequency of the dipole antenna illustrated in FIG. 13.

FIG. 20 is a graph showing how the first resonance frequency f1 and the second resonance frequency f2 change as w/h2 is changed. Note that the graph is obtained on a condition where each section of the dipole antenna 30 has the following size. Here, each of the antenna elements 31 and 32 is constituted by an electrically conductive wire having a radius of 1 mm.

L31*a* (length of linear section 31*a*)=L32*a* (length of linear section 32*a*)=3 mm (fixed)

L31*b* (length of linear section 31*b*)=L32*b* (length of linear section 32*b*)=h2=34 mm (fixed)

Gap Δ between antenna elements 31 and 32 facing each other via feed point 33=2 mm (fixed)

Distance δ between center axis of linear section 31*a* and center axis of linear section 31*b*=distance δ between center axis of linear section 32*a* and center axis of linear section 32*b*=w (variable)

As shown in FIG. 20, the first resonance frequency f1 and the second resonance frequency f2 are not changed largely, in a case where a value of w/h2 is changed on a condition of w/h2≥0.07. That is, the parameter of w/h2 does not have a significant influence on the first resonance frequency f1 and the second resonance frequency f2. In practical use, the value of w/h2 may be set to be not less than 0.05 but not more than 0.25.

Embodiment 2

Embodiment 2 of the second basic arrangement of the present invention is described below with reference to drawings.

Figure 21:
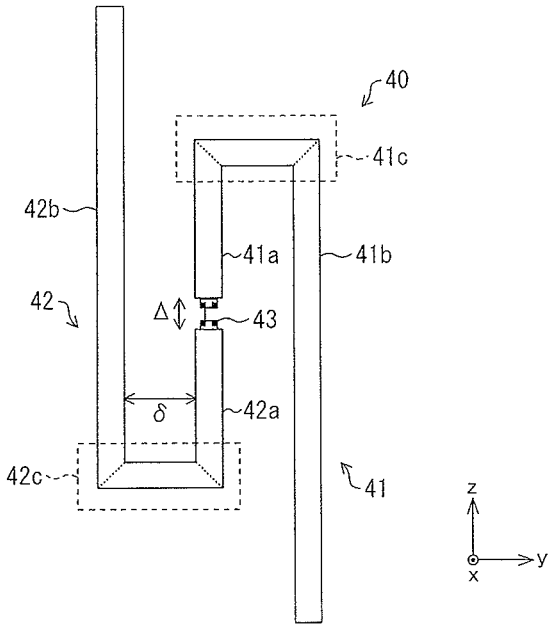
FIG. 21 is a plan view illustrating a structure of a dipole antenna in accordance with Embodiment 2 of the second basic arrangement of the present invention.

FIG. 21 is a view illustrating a structure of a dipole antenna 40 of the present embodiment. The dipole antenna includes an antenna element 41 and an antenna element 42, which are arranged on a single plane (y-z plane) (see FIG. 21). Each of the antenna elements 41 and 42 of the dipole antenna 40 of the present embodiment is constituted by an electrically conductive film, more specifically, a piece (width: 2 mm) of an electrically conductive film.

The antenna element 41 includes a linear section 41*a* extending from a feed point 43 in a plus direction of a z axis, a linear section 41*b* being connected to the linear section 41*a* via a bending section 41*c*, the linear section 41*b* extending from the bending section 41*c* in a minus direction of the z axis. The antenna element 41 terminates at one of end points of the linear section 41*b*, which one of end sections of the linear section 41*b* is on a side opposite to a bending section 41*c* side. Further, the antenna element 42 includes a linear section 42*a* extending from the feed point 43 in the minus direction of the z axis, a linear section 42*b* being connected to the linear section 42*a* via a bending section 42*c*, the linear section 42*b* extending from the bending section 42*c* in the plus direction of the z axis. The antenna element 42 terminates at one of end points of the linear section 42*b*, which one of end sections of the linear section 42*b* is on a side opposite to a bending section 42*c* side.

Furthermore, each section of the dipole antenna 40 of the present embodiment has the following size.

Figure 22:
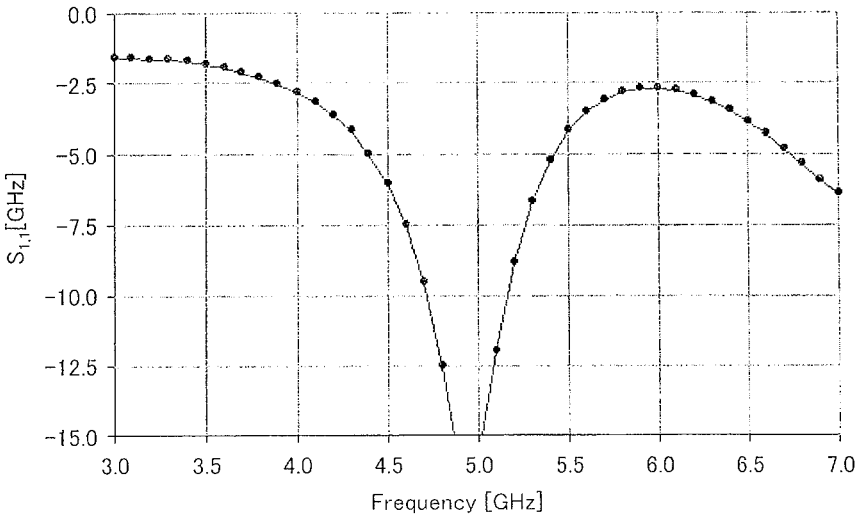
FIG. 22 is a graph showing a frequency dependency of an input reflection coefficient of the dipole antenna illustrated in FIG. 21.
Figure 23:
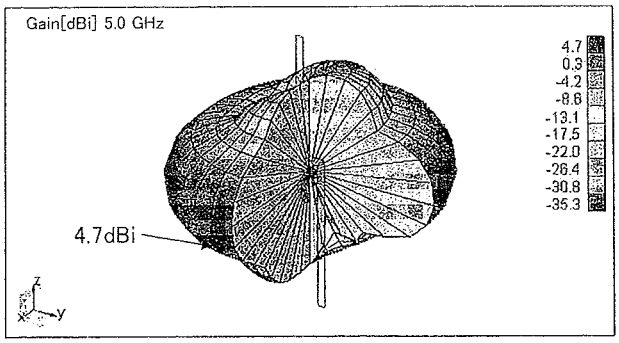
FIG. 23 is a graph showing a radiation pattern of the dipole antenna illustrated in FIG. 21.

L41*a* (length of linear section 41*a*)=L42*a* (length of linear section 42*a*)=3 mm L41*b* (length of linear section 41*b*)=L42*b* (length of linear section 42*b*)=40 mm Gap Δ between antenna elements 41 and 42 facing each other via feed point 43=2 mm Gap δ between linear sections 41*a* and 41*b*=gap 8 between linear sections 42*a* and 42*b*=1 mm Each of FIGS. 22 and 23 shows a property of the dipole antenna 40 thus arranged. FIG. 22 is a graph showing frequency dependency of an input reflection coefficient $S_{1,1}$ in the vicinity of a frequency of 5.0 GHz. FIG. 23 is a graph showing a radiation pattern at a frequency of 5.0 GHz.

FIG. 22 shows that, for example, in a case where an operation condition of $|S_{1,1}| \leq -5.1$ dB is set with respect to the input reflection coefficient $S_{1,1}$, the operation bandwidth is constituted by a bandwidth of not less than 4.4 GHz but not more than 5.4 GHz (fractional bandwidth: 20%). Further, FIG. 23 shows that it is possible to obtain a high radiant gain $G_0$ (4.7 dBi) at a frequency of 5.0 GHz. That is, according to the dipole antenna 40 arranged described above, it is possible to obtain a wide operation bandwidth in the vicinity of 5.0 GHz while ensuring a high radiant gain $G_0$.

Modified Example 1

The antenna element 41 of the present embodiment terminates at one of end points of the linear section 41*b* (which is on the side opposite to the bending section 41*c* side). Note, however, that the present invention is not limited to this. That is, by providing the one of end points of the linear section 41*b* (which is on the side opposite to the bending section 41*c* side) with an additional element, it is possible to modify the antenna element 41 so that the antenna element 41 does not terminate at the one of end points of the linear section 41*b* (which is on the side opposite to the bending section 41*c* side). Such an additional element may be an electrically conductive film or an electrically conductive wire. Further, examples of a shape of the additional element of the antenna element 41 encompass various shapes such as a straight line shape, a curved line shape, and a meander shape. This also applies to the antenna element 42.

Figure 24:
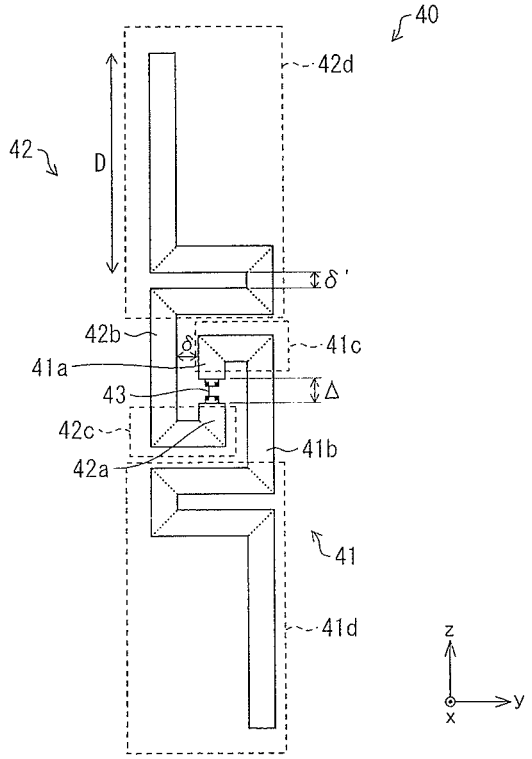
FIG. 24 is a plan view illustrating a structure of a dipole antenna in accordance with a first modified example of Embodiment 2 of the second basic arrangement of the present invention.

FIG. 24 illustrates the dipole antenna 40 in which the antenna elements 41 and 42 are provided with respective meander sections 41*d* and 42*d*. The antenna element 41 is provided with the meander section 41*d* (first meander section) which extends from one of end points of the linear section 41*b* in a minus direction of a z axis (a direction opposite to the first direction), which one of end points is on the side opposite to the bending section 41*c* side. Further, the antenna element 42 is provided with the meander section 42*d* (second meander section) which extends from one of end points of the linear section 42*b* in a plus direction of the z axis, which one of end points of the linear section 42*b* is on the side opposite to the bending section 42*c* side. With the arrangement employing the meander section 41*d* at least a part of which has a meander shape and the meander section 42*d* at least a part of which has a meander shape, it is possible to realize a still more compact dipole antenna 40.

Note that the one of end points of the linear section 41*b*, which is on the side opposite to the bending section 41*c* side, is a point which serves as one of end points of the linear section 41*b* when the meander section 41*d* is detached. This also applies to the one of end points of the linear section 42*b*, which is on the side opposite to the bending section 42*c* side.

Further, the direction in which the meander section extends can be defined as described below. That is, for example, the meander section 42*d* has a meander part which extends, from a feed point 43 side, in (i) a plus direction of a y axis, (ii) the plus direction of a z axis, (iii) a minus direction of the y axis, (iv) the plus direction of the z axis, . . . , in this order. In other words, there are two types of direction in which the meander part of the meander section 42*d* extends, namely, the direction which is inverted alternately (in this case, the direction along the y axis) and the direction which is not inverted (in this case, the direction along the z axis). The two types of direction alternate with each other as the meander part of the meander section 42*d* extends. Among these, the direction which is not inverted is the direction in which the meander section 42*d* extends. This also applies to the meander section 41*d*.

Note that each section of the dipole antenna 40 of the present modified example is set to have the following size.

Figure 25:
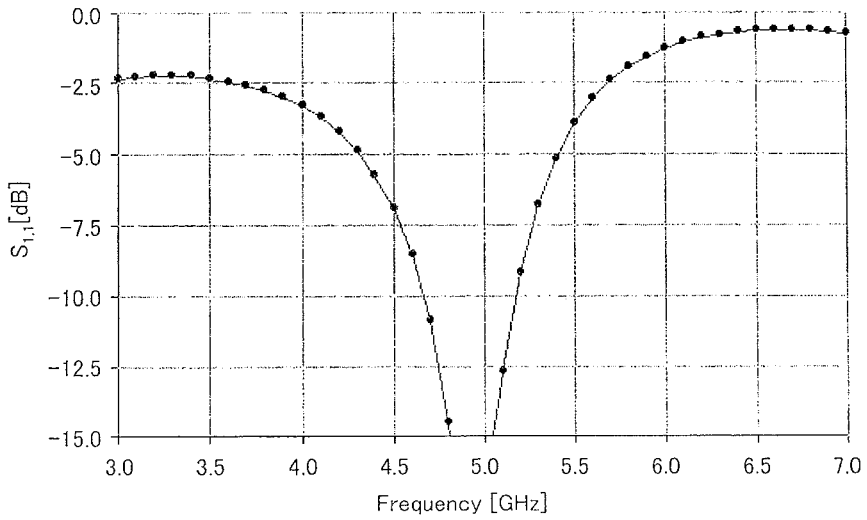
FIG. 25 is a graph showing frequency dependency of an input reflection coefficient of the dipole antenna illustrated in FIG. 24.
Figure 26:
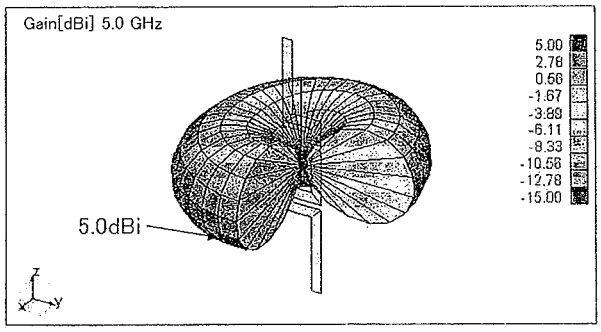
FIG. 26 is a graph showing a radiation pattern of the dipole antenna illustrated in FIG. 24.

L41*a* (length of linear section 41*a*)=L42*a* (length of linear section 42*a*)=3 mm L41*b* (length of linear section 41*b*)=L42*b* (length of linear section 42*b*)=12 mm Gap Δ between antenna elements 41 and 42 facing each other via feed point 43=2 mm Gap δ between linear sections 41*a* and 41*b*=gap δ between linear sections 42*a* and 42*b*=1 mm Length D of linear section of meander section 42*d*, which linear section extends in direction along z axis=length of linear section of meander section 41*d*, which linear section extends in direction opposite to above direction along z axis=15 mm Gap δ' between linear section of meander section 42*d*, extending in direction along y axis, and linear section of meander section 42*d*, extending in direction opposite to above direction along y axis=gap δ' between linear section of meander section 41*d*, extending in direction along y axis, and linear section of meander section 41*d*, extending in direction opposite to above direction in y axis=1 mm Each of FIGS. 25 and 26 shows a property of the dipole antenna 40 thus arranged. FIG. 25 is a graph showing frequency dependency of an input reflection coefficient $S_{1,1}$ in the vicinity of a frequency of 5.0 GHz. FIG. 26 is a graph showing a radiation pattern at a frequency of 5.0 GHz.

FIG. 15 shows that, for example, in a case where an operation condition of $|S_{1,1}| \leq -5.1$ dB is set with respect to the input reflection coefficient $S_{1,1}$, the operation bandwidth is constituted by a bandwidth of not less than 4.3 GHz but not more than 5.4 GHz (fractional bandwidth: 23%). Further, FIG. 26 shows that it is possible to obtain a high radiant gain $G_0$ (5.0 dBi) at a frequency of 5.0 GHz. That is, according to the dipole antenna 40 arranged as described above, it is possible to obtain a wide operation bandwidth in the vicinity of a frequency of 5.0 GHz while ensuring a high radiant gain $G_0$. Further, by comparing FIGS. 26 and 23 with each other, it becomes clear that the arrangement employing the meander sections makes it possible to obtain a radiation pattern which has a higher symmetric property and is more stable, as compared with the arrangement employing no meander section.

Modified Example 2

In the aforementioned Modified Example 1, the meander section 41*d* has a single meander part. Note, however, that the present invention is not limited to this. That is, the meander section 41*d* can include two or more meander parts. This also applies to the meander section 42*d*.

Figure 27:
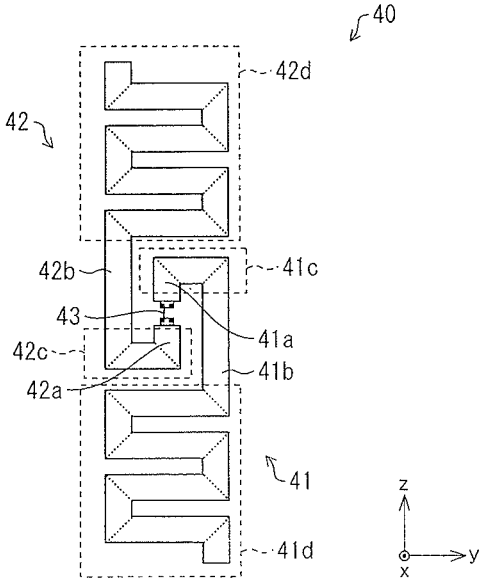
FIG. 27 is a plan view illustrating a structure of a dipole antenna in accordance with a second modified example of Embodiment 2 of the second basic arrangement of the present invention.

FIG. 27 illustrates the dipole antenna 40 in which each of the meander sections 41*d* and 42*d* is modified to have two meander parts. By employing the meander sections 41*d* and 42*d* each including a plurality of meander parts (as illustrated in FIG. 27), it is possible to realize a still more compact dipole antenna 40.

Note that the number of a plurality of meander parts can be defined as described below. That is, the number of times that the meander section extends in a direction which is not inverted is the number of the plurality of meander parts. In other words, the number of times the meander section extends in the direction which is not inverted is 2N, the meander section has N meander parts.

Modified Example 3

In the aforementioned Modified Example 1, the direction in which the meander section 41*d* extends and the direction in which the linear section 41*b* extends are identical with each other. Note, however, that the present invention is not limited to this. That is, for example, it is possible to have an arrangement in which the direction in which the meander section 41*d* extends is orthogonal to the direction in which the linear section 41*b* extends. This also applies to the direction in which the meander section 42*d* extends.

Figure 28:
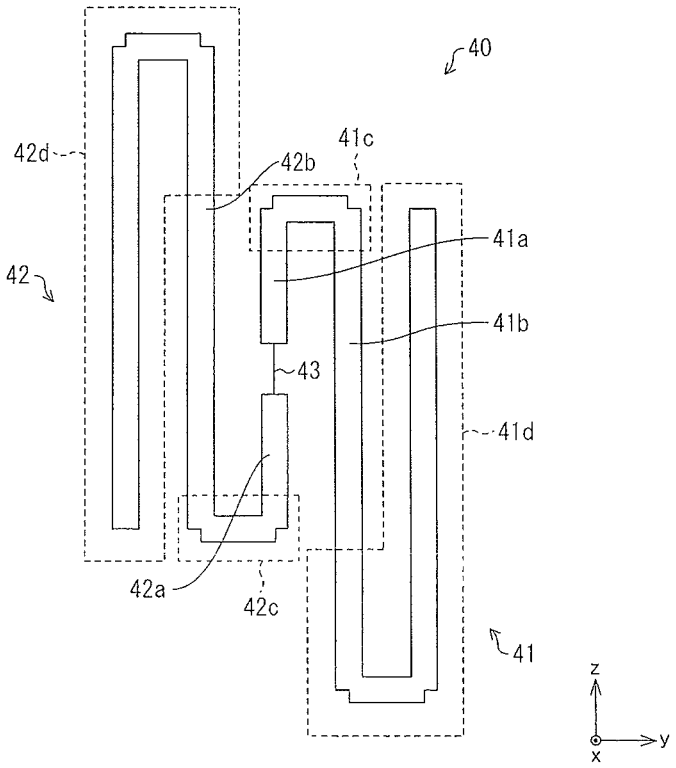
FIG. 28 is a plan view illustrating a structure of a dipole antenna in accordance with a third modified example of Embodiment 2 of the second basic arrangement of the present invention.

FIG. 28 illustrates the dipole antenna 40 which is modified such that the direction in which the meander section 41*d* extends is orthogonal to the direction in which the linear section 41*b* extends. The antenna element 41 is provided with the meander section 41*d*, which extends from one of end points of the linear section 41*b* in the plus direction of the y axis, which one of end points of the linear section 41*b* is on a side opposite to a linear section 41*a* side. Further, the antenna element 42 is provided with the meander section 42*d*, which extends from one of end points of the linear section 42*b* in the minus direction of the y axis, which one of end points of the linear section 42*b* is on a side opposite to a linear section 42*a* side. By employing such meander sections 41*d* and 42*d*, it is also possible to realize a still more compact dipole antenna.

Note that meander structures of Modified Examples 1 through 3 described above can be applied not only to the present embodiment in which each of the antenna elements 41 and 42 is constituted by an electrically conductive film but also to Embodiment 1 in which each of antenna elements 31 and 32 is constituted by an electrically conductive wire.

[Power Feeding Arrangement]

Figure 29:
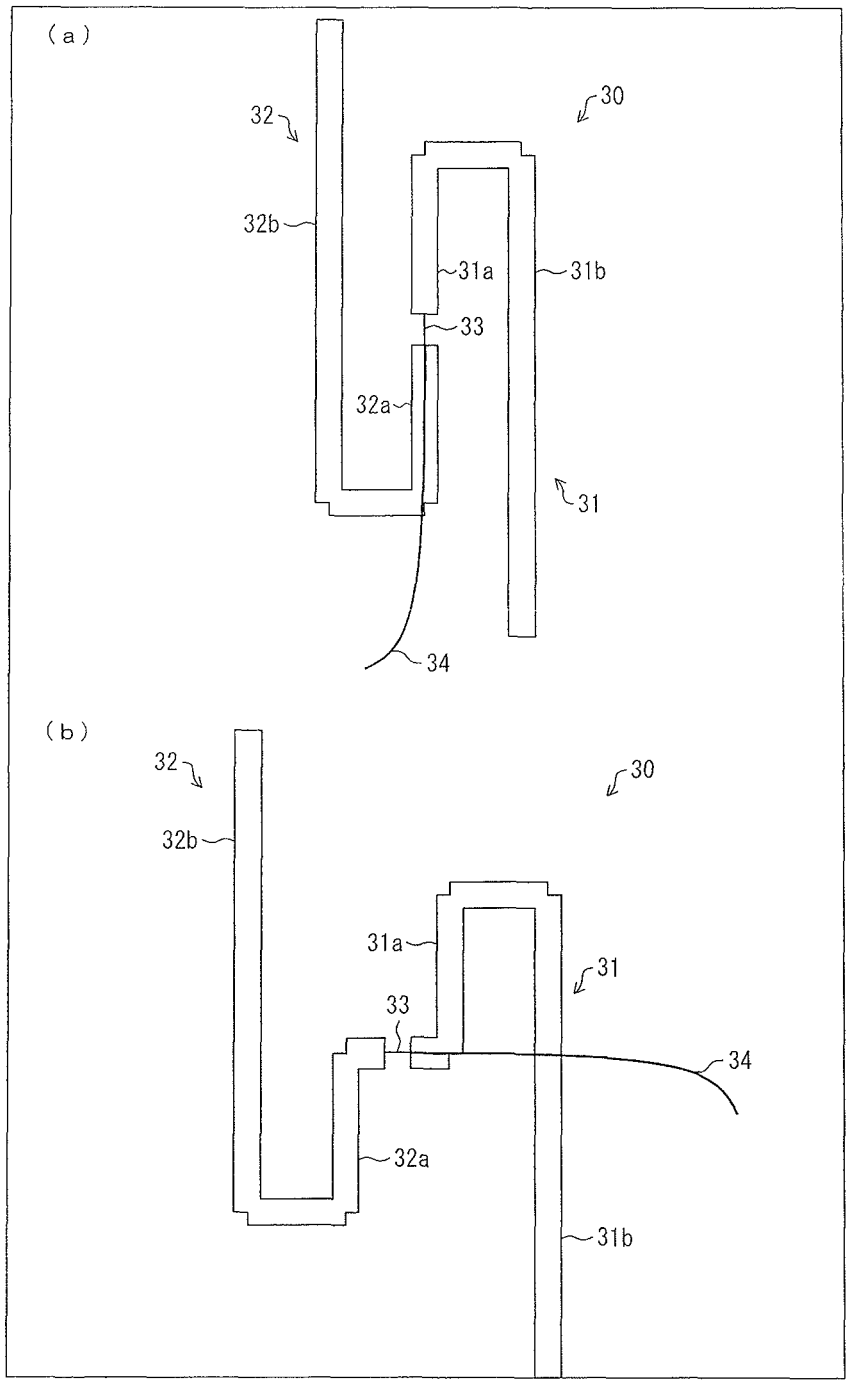
FIG. 29 is an explanatory view illustrating how to supply electric power to the dipole antenna of the second basic form of the present invention: (a) of FIG. 29 is a plan view illustrating how to supply electric power to a dipole antenna in accordance with an embodiment of the present invention; and (b) of FIG. 29 is a plan view illustrating how to supply electric power to a dipole antenna in accordance with another embodiment of the present invention.
Figure 30:
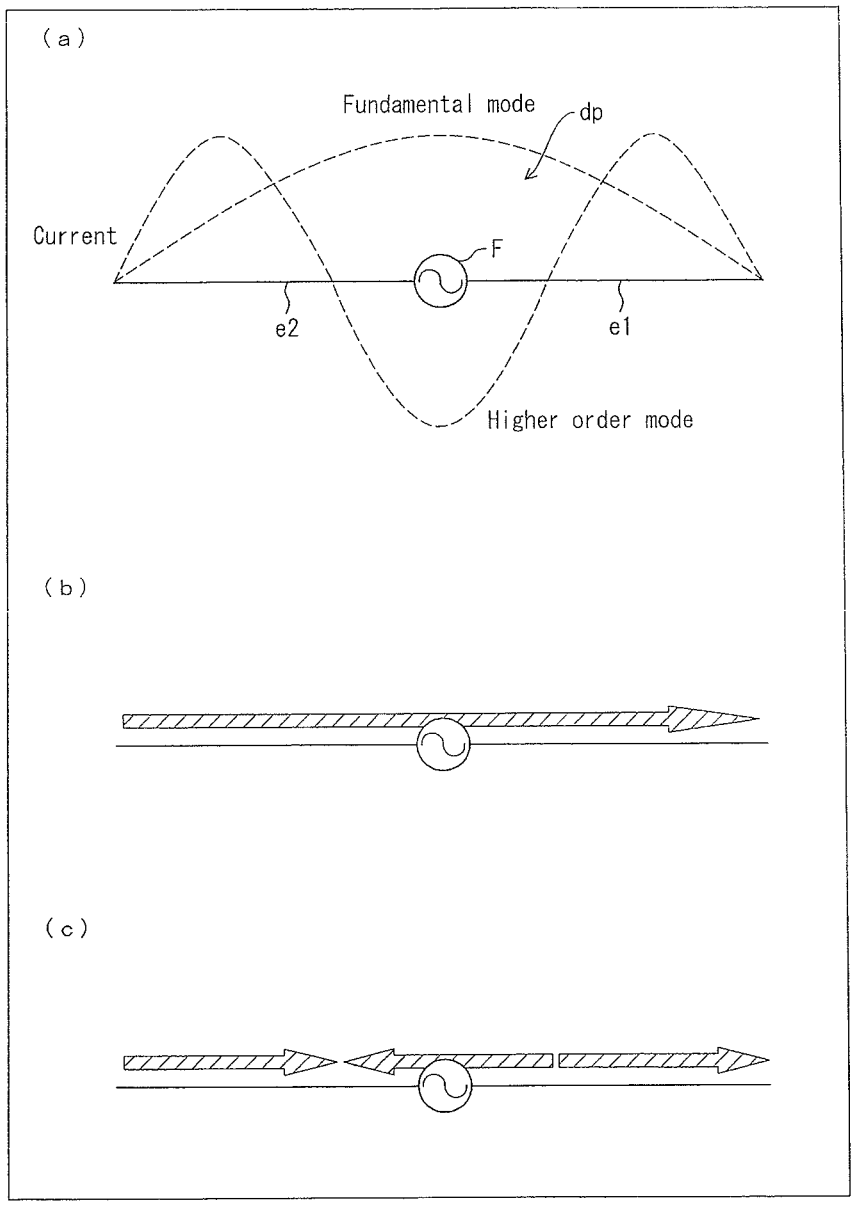
FIG. 30 is an explanatory view illustrating a conventional dipole antenna: (a) of FIG. 30 is a view illustrating (i) a structure of the conventional dipole antenna and (ii) a resonance mode of the conventional dipole antenna; (b) of FIG. 30 is a view illustrating current distribution of the dipole antenna at the first resonance frequency; and (c) of FIG. 30 is a view illustrating current distribution of the dipole antenna at the second resonance frequency.
Figure 31:
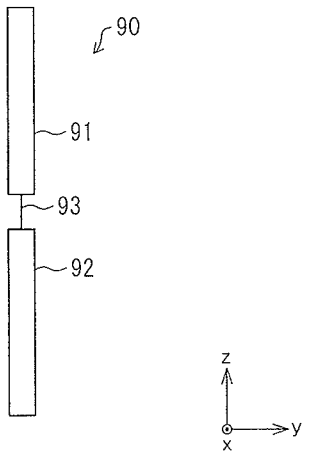
FIG. 31 is a plan view illustrating a structure of a conventional dipole antenna.
Figure 32:
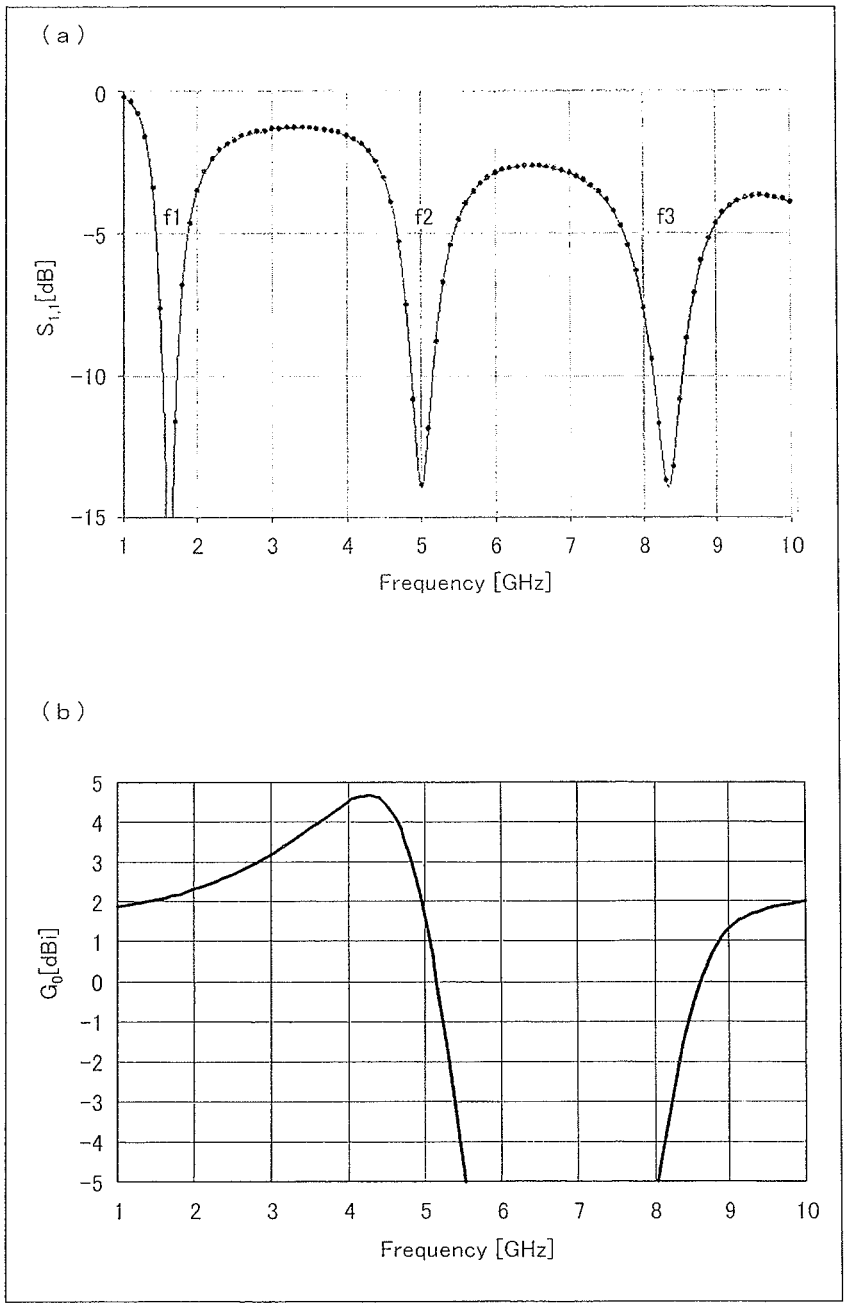
FIG. 32 is a graph showing a property of the dipole antenna illustrated in FIG. 31: (a) of FIG. 32 is a graph showing frequency dependency of an input reflection coefficient; and (b) of FIG. 32 is a graph showing frequency dependency of a radiant gain.
Figure 33:
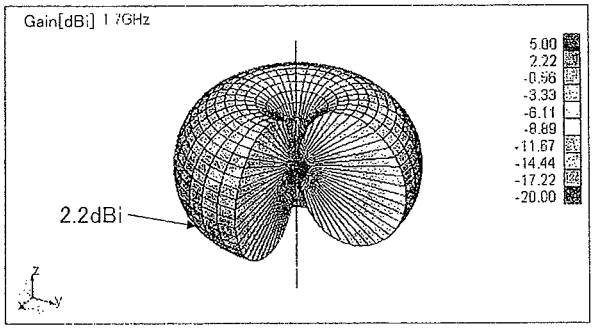
FIG. 33 is a graph showing a radiation pattern of the dipole antenna illustrated in FIG. 31: (a) of FIG. 33 is a graph showing a radiation pattern at a frequency of 1.7 GHz; (b) of FIG. 33 is a graph showing a radiation pattern at a frequency of 3.4 GHz; and (c) of FIG. 33 is a graph showing a radiation pattern at a frequency of 5.1 GHz.
Figure 33:
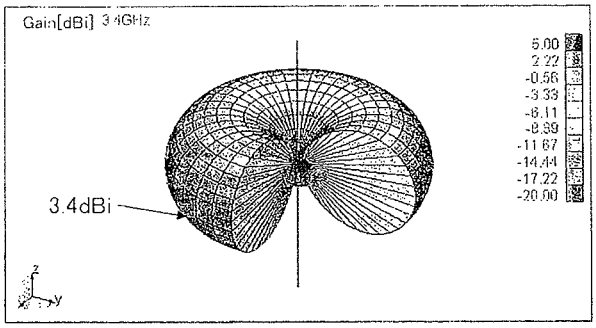
Figure 33:
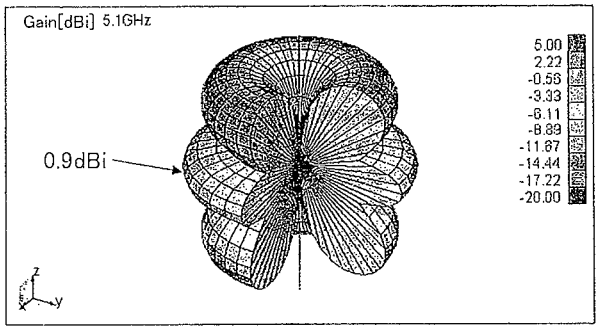
Figure 34:
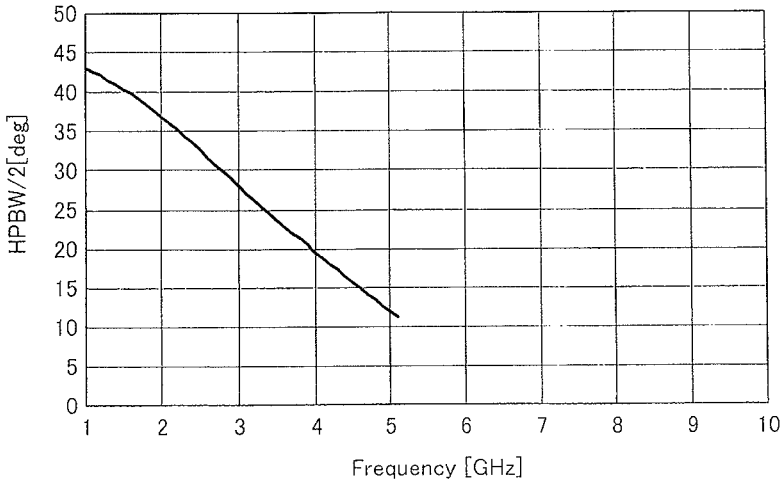
FIG. 34 is a graph showing frequency dependency of an HPBW of the dipole antenna illustrated in FIG. 31.

Lastly, how to supply electric power to a dipole antenna of the present invention is described below with reference to FIG. 29. FIG. 29 illustrates how to supply electric power to a dipole antenna 30 of Embodiment 1. Note, however, that this also applies to how to supply electric power to a dipole antenna 40 of Embodiment 2.

(a) of FIG. 29 illustrates a power feeding arrangement in which electric power is supplied via a coaxial cable 34 inserted into a feed point 33 along a linear section 32*a* (balanced feeding). (b) of FIG. 29 illustrates a power feeding arrangement in which electric power is supplied via a coaxial cable 34 inserted into the feed point 33 along a straight line (not illustrated) which passes through the feed point 33 and is orthogonal to the linear section 32*a* (balanced feeding). Either in the arrangement illustrated in (a) of FIG. 29 or the arrangement illustrated in (b) of FIG. 29, an internal conductor of the coaxial cable 34 is connected to one of the antenna elements 31 and 32, and an outer conductor of the coaxial cable 34 is connected to the other one of the antenna elements 31 and 32.

Note that in a case where the arrangement illustrated in (b) of FIG. 29 is employed, it is preferable, for impedance match with the coaxial cable 34, to (i) bend, in an inward direction (toward the feed point 33), one of end sections of the linear section 31*a* to be along the coaxial cable 34, which one of end sections of the linear section 31*a* is on a feed point 33 side, and (ii) bend, in the inward direction (toward the feed point 33), one of end sections of the linear section 32*a* to be along the coaxial cable 34, which one of end sections of the linear section 32*a* is on a feed point 33 side.

[Relationship Between First Basic Arrangement and Second Basic Arrangement]

First, in a case where a feed point 11*e* is referred to as "first feed point", and a feed point 11*f* is referred to as "second feed point", a dipole antenna 10 of a first basic arrangement of the present invention, illustrated in FIG. 4, can be expressed as described below. That is, a dipole antenna 10 includes an antenna element 11 (first antenna element) and an antenna element 12 (second antenna element), the antenna element 11 (first antenna element) including a linear section 11*a* (first linear section) extending from a first feed point in a first direction, and a linear section 11*b* (second linear section) being connected to one of ends of the linear section 11*a* (first linear section) via a first bending section, which one of ends of the linear section 11*a* (first linear section) is on a side opposite to the first feed point, the linear section 11*b* (second linear section) extending from the first bending section in a direction opposite to the first direction, the antenna element 12 (second antenna element) including a linear section 12*a* (third linear section) extending from a second feed point in the direction opposite to the first direction, and a linear section 12*b* (fourth linear section) being connected to one of ends of the linear section 12*a* (third linear section) via a second bending section, which one of ends of the linear section 12*a* (third linear section) is on a side opposite to the second feed point, the linear section 12*b* (fourth linear section) extending from the second bending section in the first direction. Particularly, according to the dipole antenna 10 illustrated in FIG. 4, (i) the first feed point is provided on an intermediate part of the first linear section 11*a*, (ii) the second feed point is provided on an intermediate part of the third linear section 12*a*, (iii) the first linear section 11*a* is provided between the third linear section 12*a* and the fourth linear section 12*b*, and (iv) the third linear section 12*a* is provided between the first linear section 11*a* and the second linear section 11*b*.

Further, in a case where a connection point between a coaxial cable 34 (feed line) and an antenna element 31 (first antenna element) is referred to as "first feed point", and a connection point between the coaxial cable 34 (feed line) and an antenna element 32 (second antenna element) is referred to as "second feed point", a dipole antenna 30 of the second basic arrangement of the present invention, illustrated in (a) and (b) of FIG. 29 can be expressed as described below. That is, a dipole antenna 30 includes an antenna element 31 (first antenna element) and an antenna element 32 (second antenna element), the antenna element 31 (first antenna element) including a linear section 31*a* (first linear section) extending from a first feed point in a first direction, and a linear section 31*b* (second linear section) being connected to one of ends of the linear section 31*a* (first linear section) via a first bending section, which one of ends of the linear section 31*a* (first linear section) is on a side opposite to the first feed point, the linear section 31*b* (second linear section) extending from the first bending section in a direction opposite to the first direction, the antenna element 32 (second antenna element) including a linear section 32*a* (third linear section) extending from a second feed point in the second direction, and a linear section 32*b* (fourth linear section) being connected to one of ends of the linear section 32*a* (third linear section) via a second bending section, which one of ends of the linear section 32*a* (third linear section) is on a side opposite to the second feed point, the linear section 32*b* (fourth linear section) extending from the second bending section in the first direction. Particularly, according to the dipole antenna 30 illustrated in (a) of FIG. 29, (i) the linear section 31*a* (first linear section) and the linear section 32*a* (third linear section) are arranged in line, and, according to the dipole antenna 30 illustrated in (b) of FIG. 29, the linear section 31*a* (first linear section) and the linear section 32*a* (third linear section) are arranged in line.

Further, the dipole antenna of the present invention can be also expressed as described below. That is, a dipole antenna of the present invention includes a first antenna element and a second antenna element, the first antenna element including a first linear section extending from one of ends of the first antenna element in a first direction, and a second linear section being connected to the first linear section via a first bending section, the second linear section extending from the first bending section in a direction opposite to the first direction, the second antenna element including a third linear section extending from one of ends of the second antenna element in the direction opposite to the first direction, and a fourth linear section being connected to the third linear section via a second bending section, the fourth linear section extending from the second bending section in the first direction, the first linear section having a feed point on an intermediate part of the first linear section, the third linear section having another feed point on an intermediate part of the third linear section, the first linear section being provided between the third linear section and the fourth linear section, the third linear section being provided between the first linear section and the second linear section.

Here, the wording "intermediate" of "on an intermediate part" of the first linear section means any point on the first linear section between end points of the first linear section, and is not limited to a midpoint between the end points of the first linear section. In the same manner, the wording "intermediate" of "on an intermediate part" of the third linear section means any point on the third linear section between end points of the third linear section, and is not limited to a midpoint between the end points of the third linear section.

According to the arrangement described above, it is possible to cause a direction in which a current flows through the first antenna element at a second resonance frequency and a direction in which a current flows through the second antenna element at the second resonance frequency to be substantially identical with each other. This allows a radiation pattern at the second resonance frequency to be likely to be a single-peaked radiation pattern. As a result, the second resonance frequency is shifted toward a low-frequency side.

Here, such a single-peaked radiation pattern at the second resonance frequency means that the second resonance frequency is shifted toward the low-frequency side with respect to a frequency at which a radiant gain shows a local maximum value, that is, there is no sharp reduction in radiant gain between the first resonance frequency and the second resonance frequency. Accordingly, in a case where the radiation pattern at the second resonance frequency becomes a single-peaked radiation pattern, it becomes possible to use, as an operation bandwidth satisfying an operation condition set with respect to the radiant gain, a bandwidth in the vicinity of the second resonance frequency, which bandwidth could not be used as the operation bandwidth with a conventional arrangement due to a sharp reduction in radiant gain.

Moreover, the second resonance frequency is shifted toward the low-frequency side, so that the first resonance frequency and the second resonance frequency become close to each other. As a result, an input reflection coefficient is reduced through an entire bandwidth between the first resonance frequency and the second resonance frequency. Accordingly, in a case where the radiant gain between the first resonance frequency and the second resonance frequency satisfies the operation condition, it is possible to use, as the operation bandwidth, the entire bandwidth between the first resonance frequency and the second resonance frequency.

In other words, by allowing the bandwidth in the vicinity of the second resonance frequency to be included in the operation bandwidth newly, which bandwidth could not be used as the operation bandwidth with the conventional arrangement, it is possible to widen the operation bandwidth.

Further, with the aforementioned arrangements of the first antenna element and the second antenna element, it is possible to realize a dipole antenna whose entire length is identical with a conventional dipole antenna but which is more compact than the conventional dipole antenna. Moreover, according to the dipole antenna of the present invention, not only the first antenna element and the second antenna element are merely bent but also the first antenna element is provided between the linear sections of the second antenna element and the second antenna element is provided between the linear sections of the first antenna element. With the arrangement, it is possible to realize a still more compact dipole antenna.

Note that the "direction" of "the first direction" is an oriented direction. That is, in a case where a direction from south to north is the first direction, for example, a direction from north to south is the direction opposite to the first direction.

The dipole antenna of the present invention preferably arranged such that a length of the second linear section is greater than a sum of (i) a length of a part of the first linear section, which part extends toward the first bending section from the first feed point, and (ii) a length of a part of the third linear section, which part extends toward the second bending section from the second feed point, and a length of the fourth linear section is greater than said sum.

At a first resonance frequency, a direction in which a current flows through the first antenna element and a direction in which a current flows through the second antenna element are caused to be different from each other. For this reason, there is a risk of a reduction in radiant gain in the vicinity of the first resonance frequency. This is because a part of an electromagnetic wave radiated from the second linear section and a part of an electromagnetic wave radiated from the fourth linear section are cancelled with, respectively, electromagnetic waves radiated from the respective first linear section and the third linear section.

With the arrangement, however, it is possible to reduce a proportion of the parts of the electromagnetic waves radiated from the respective second linear section and the fourth linear section, which parts are cancelled with, respectively, the electromagnetic waves radiated from the respective first linear section and the third linear section. Accordingly, it is possible to realize an additional effect of suppressing a reduction in radiant gain $G_0$, which reduction could be caused in the vicinity of the first resonance frequency.

The dipole antenna of the present invention preferably further includes an electrically conductive member being provided (i) in a gap between the first linear section and the second antenna element or (ii) in a gap between the third linear section and the first antenna element.

With the arrangement, it is possible to adjust, without changing shapes of the first antenna element and the second antenna element, a parasitic reactance between the first antenna element and the second antenna element more effectively, as compared with an arrangement in which the electrically conductive member is provided at a position other than the gaps described above. Accordingly, it is possible to realize a dipole antenna whose property can be adjusted easily.

Note that the dipole antenna of the present invention may include the electrically conductive member in each of the gaps, namely the gap between the first linear section and the second antenna element and the gap between the third linear section and the first antenna element, or may include the electrically conductive member in one of the gaps.

The dipole antenna of the present invention preferably further includes an electrically conductive member, the electrically conductive member being provided so as to cover, via a dielectric sheet, (i) at least a part of a gap between the first linear section and the second antenna element or (ii) at least a part of a gap between the third linear section and the first antenna element.

According to the arrangement, it is possible to adjust, without changing shapes of the first antenna element and the second antenna element, a parasitic reactance between the first antenna element and the second antenna element more effectively, as compared with an arrangement in which the electrically conductive member is provided at a position other than the gaps described above. Accordingly, it is possible to realize a dipole antenna whose property can be adjusted easily.

Note that the dipole antenna of the present invention may include both the electrically conductive member which covers at least a part of the gap between the first linear section and the second antenna element and the electrically conductive member which covers at least a part of the gap between the third linear section and the first antenna element, or may include the electrically conductive member which covers at least a part of one of the gaps.

The dipole antenna of the present invention is preferably arranged such that the first antenna element further includes a first wide width section which (i) is connected to one of ends of the second linear section, which one of ends of the second linear section is on a side opposite to the first bending section, and (ii) has a width which is greater than that of the second linear section, and the second antenna element further includes a second wide width section which (I) is connected to one of ends of the fourth linear section, which one of ends of the fourth linear section is on a side opposite to the second bending section, and (II) has a width which is greater than that of the fourth linear section.

According to the arrangement, by providing the wide width sections, it is possible to cause electrical lengths of the first antenna element and the second antenna element to be longer. That is, it is possible to shift the operation bandwidth toward the low-frequency side without an increase in size of the dipole antenna. Further, it is possible to realize the dipole antenna having low directivity.

The dipole antenna of the present invention is preferably arranged such that the width of the first wide width section or the width of the second wide width section is not less than c/(128f) (where: f is a frequency within an operation bandwidth; and c is a velocity of light).

According to the arrangement, it is possible to (i) reduce a VSWR in a higher order mode, and therefore (ii) further widen the operation bandwidth. Further, it is possible to further reduce the directivity of the dipole antenna.

Note that the dipole antenna may be such that both the width of the first wide width section and the width of the second wide width section are not less than c/(128f), or may be arranged such that one of the widths is not less than c/(128f).

The dipole antenna of the present invention is preferably arranged such that a length of the second linear section or a length of the fourth linear section is not less than c/(16f) (where: f is a frequency within an operation bandwidth; and c is a velocity of light).

According to the arrangement, it is possible to (i) reduce the VSWR in the higher order mode, and therefore (ii) further widen the operation bandwidth. Further, it is possible to further reduce the directivity.

Note that the dipole antenna may be such that both the length of the second linear section and the length of the fourth linear section are not less than c/(16f), or may be arranged such that one of the lengths is not less than c/(16f).

The dipole antenna of the present invention preferably further includes an electrically conductive member being provided (i) in a gap between the second bending section and the first wide width section or (ii) in a gap between the first bending section and the second wide width section.

According to the arrangement, it is possible to adjust, without changing shapes of the first antenna element and the second antenna element, a parasitic reactance between the first antenna element and the second antenna element more effectively, as compared with an arrangement in which the electrically conductive member is provided at a position other than the gaps described above. Accordingly, it is possible to realize a dipole antenna whose property can be adjusted easily.

Note that the dipole antenna of the present invention may include the electrically conductive member in each of the gaps, namely, the gap between the second bending section and the first wide width section and the gap between the first bending section and the second wide width section, or may include the electrically conductive member in one of the gaps.

The dipole antenna of the present invention preferably further includes an electrically conductive member, the electrically conductive member being provided so as to cover, via a dielectric sheet, (i) at least a part of a gap between the second bending section and the first wide width section or (ii) at least a part of a gap between the first bending section and the second wide width section.

According to the arrangement, it is possible to adjust, without changing shapes of the first antenna element and the second antenna element, a parasitic reactance between the first antenna element and the second antenna element more effectively, as compared with an arrangement in which the electrically conductive member is provided at a position other than the gaps described above. Accordingly, it is possible to realize a dipole antenna whose property can be adjusted easily.

Note that the dipole antenna of the present invention may include both the electrically conductive member which covers at least a part of the gap between the second bending section and the first wide width section, and the electrically conductive member which covers at least a part of the gap between the first bending section and the second wide width section, or may include the electrically conductive member which covers at least a part of one of the gaps.

The dipole antenna of the present invention is preferably arranged such that the first wide width section is formed to have a rectangular shape whose long side is parallel to the first direction, and the second wide width section is formed to have a rectangular shape whose long side is vertical to the first direction.

According to the arrangement, it is possible to reduce a size of the dipole antenna in the first direction and in the direction opposite to the first direction, as compared with an arrangement in which the second wide width section has a rectangular shape whose long side is perpendicular to the first direction. Further, according to the arrangement, the dipole antenna has an L shape as a whole. Accordingly, it is possible to provide easily the dipole antenna in a small wireless device etc. each having an L-shaped space.

The dipole antenna of the present invention is preferably arranged such that the first wide width section is formed to have a rectangular shape whose long side is parallel to the first direction, and the second wide width section is formed to have a rectangular shape whose long side is parallel to the first direction.

According to the arrangement, it is possible to reduce a size of the dipole antenna in the first direction and in the direction opposite to the first direction, as compared with an arrangement in which the second wide width section has a rectangular shape whose long side is perpendicular to the first direction. Further, according to the arrangement, the dipole antenna has an I shape as a whole. Accordingly, it is possible to provide easily in a small wireless device etc. each having an I-shaped space.

A dipole antenna of the preset invention includes: a first antenna element; and a second antenna element, the first antenna element including: a first linear section extending from a feed point in a first direction; and a second linear section being connected to one of ends of the first linear section via a first bending section, which one of ends of the first linear section is on a side opposite to the feed point, the second linear section extending from the first bending section in a direction opposite to the first direction, the second antenna element including: a third linear section extending from the feed point in the direction opposite to the first direction; and a fourth linear section being connected to one of ends of the third linear section via a second bending section, which one of ends of the third linear section is on a side opposite to the feed point, the fourth linear section extending from the second bending section in the first direction.

According to the arrangement, it is possible to cause a direction in which a current flows through the first antenna element and a direction in which a current flows through the second antenna element to be identical with each other. This shifts the second resonance frequency toward a low-frequency side. That is, it is possible to cause a radiation pattern at the second resonance frequency to be a single-peaked radiation pattern.

Here, the single-peaked radiation pattern at the second resonance frequency means that the second resonance frequency is shifted toward the low-frequency side with respect to a frequency at which a radiant gain shows a local maximum value, that is, there is no sharp reduction in radiant gain between the first resonance frequency and the second resonance frequency. Accordingly, it is possible to use, as an operation bandwidth satisfying an operation condition set with respect to the radiant gain, a bandwidth in the vicinity of the second resonance frequency, which bandwidth could not be used as the operation bandwidth with a conventional arrangement due to a sharp reduction in radiant gain.

Further, in a case where the second resonance frequency is shifted toward the low-frequency side, the first resonance frequency and the second resonance frequency become close to each other. In this case, an input reflection coefficient is reduced through an entire bandwidth between the first resonance frequency and the second resonance frequency. Moreover, there is no sharp reduction between the first resonance frequency and the second resonance frequency, as described above. Accordingly, depending on the operation condition set with respect to the input reflection coefficient, it is possible to use, as the operation bandwidth, the entire bandwidth between the first resonance frequency and the second resonance frequency.

That is, by allowing the bandwidth in the vicinity of the second resonance frequency to be included in the operation bandwidth newly, which bandwidth could not be used as the operation bandwidth with a conventional dipole antenna, it is possible to widen the operation bandwidth.

Further, with the aforementioned arrangements of the first antenna element and the second antenna element, it is possible to realize a dipole antenna whose entire length is identical with that of a conventional dipole antenna but which is more compact than the conventional dipole antenna.

Note that the "direction" of the "first direction" is an oriented direction. That is, in a case where a direction from south to north is the first direction, for example, a direction from north to south is the direction opposite to the first direction.

The dipole antenna of the present invention is preferably arranged such that a length of the second linear section is greater than a sum of (i) a length of the first linear section and (ii) a length of the third linear section, and a length of the fourth linear section is greater than the sum.

At a first resonance frequency, a direction in which a current flows through the first antenna element and a direction in which a current flows through the second antenna element are caused to be different from each other. In this case, there is a risk of a reduction in radiant gain in the vicinity of the first resonance frequency. This is because a part of an electromagnetic wave radiated from the second linear section and a part of an electromagnetic wave radiated from the fourth linear section are cancelled with, respectively, electromagnetic waves radiated from the respective first linear section and the third linear section.

With the arrangement, however, it is possible to reduce a proportion of parts of electromagnetic waves, which cancelled with, respectively, the electromagnetic waves radiated from the respective first linear section and the third linear section. Accordingly, it is possible to realize an additional effect of suppressing a reduction in radiant gain $G_0$, which reduction could be caused in the vicinity of the first resonance frequency.

The dipole antenna of the present invention is preferably arranged such that the first antenna element terminates at one of ends of the second linear section, which one of ends of the second linear section is on the side opposite to the first bending section; and the second antenna element terminates at one of ends of the fourth linear section, which one of ends of the fourth linear section is one the side opposite to the second bending section.

According to the arrangement, since the number of parameters necessary to define shapes of the first antenna element and the second antenna element is small, it is possible to realize an additional effect of designing easily, by use of a numeric simulation or the like, the first antenna element and the second antenna element to obtain a desired property.

The dipole antenna of the present invention is preferably arranged such that a ratio of a length of the first linear section to a length of the second linear section is not less than 0.05 but not more than 0.3, and a ratio of a length of the third linear section to a length of the fourth linear section is not less than 0.05 but not more than 0.3.

According to the arrangement, it is possible to realize the following additional effect. That is, since the ratio is set to be not less than 0.05, it is possible to have a sufficiently wide operation bandwidth. Further, since the ratio is set to be not more than 0.3, it is possible to obtain a sufficiently high radiant gain.

The dipole antenna of the present invention is preferably arranged such that the first antenna element further includes a meander section, at least a part of which has a meander shape, and the second antenna element further includes a meander section, at least a part of which has a meander shape.

According to the arrangement, it is possible to realize an additional effect of causing the dipole antenna having the aforementioned operation bandwidth to be more compact.

The dipole antenna of the present invention is preferably arranged such that the first antenna element further includes a first meander section, at least a part of which has a meander shape, the meander section extending, in the direction opposite to the first direction, from one of ends of the second linear section, which one of ends of the second linear section is on the side opposite to the first bending section, and the second antenna element further includes a second meander section, at least a part of which has a meander shape, the second meander section extending, in the first direction, from one of ends of the fourth linear section, which one of ends of the fourth linear section is on the side opposite to the second bending section.

According to the arrangement, (i) at least a part of the first meander section, extending in the direction opposite to the first direction, has a meander shape, and (ii) at least a part of the second meander section, extending in the first direction, has a meander shape. This makes it possible to realize an additional effect of reducing a size of the dipole antenna in the first direction and in the direction opposite to the first direction, as compared with an arrangement in which the first antenna element extends in the first direction linearly and the second antenna element extends in the direction in the direction opposite to the first direction linearly.

The dipole antenna of the present invention is preferably arranged such that the first antenna element further includes a first meander section, at least a part of which has a meander shape, the first meander section extending, in a second direction which is perpendicular to the first direction, from one of ends of the second linear section, which one of ends of the second linear section is on the side opposite to the first bending section, and the second antenna element further includes a second meander section, at least a part of which has a meander shape, the second meander section extending, in a direction opposite to the second direction, from one of ends of the fourth linear section, which one of ends of the fourth linear section is on the side opposite to the second bending section.

According to the arrangement, at least a part of the first meander section, extending in the second direction which is perpendicular to the first direction, has a meander shape, and at least a part of the second meander section, extending in the direction opposite to the second direction, has a meander shape. With the arrangement, it is possible to realize an additional effect of reducing a size of the dipole antenna in the second direction and in the direction opposite to the second direction, as compared with an arrangement in which the first antenna element extends in the second direction linearly and the second antenna element extends in the direction opposite to the second direction linearly.

The dipole antenna of the present invention can be arranged such that the first antenna element is constituted by an electrically conductive film or an electrically conductive wire, and the second antenna element is constituted by an electrically conductive film or an electrically conductive wire.

The dipole antenna of the present invention can be arranged such that the dipole antenna receives electric power via a coaxial cable which extends from the first feed point and the second feed point in the first direction or in a direction perpendicular to the first direction.

Further, the dipole antenna of the present invention can be arranged such that the first linear section and the third linear section are arranged in line, for example.

[Additional Matters]

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention can be applied to various wireless devices widely. Particularly, the present invention is suitably applicable to an antenna for a small wireless device which covers a terrestrial digital television bandwidth.

Further, the present invention can be used in various wireless devices. For example, the present invention is suitably applicable to an antenna for a small wireless device, such as a personal computer and a mobile phone terminal, and an antenna for a base station.

REFERENCE SIGNS LIST

DP, 10, 20, DP2, 30, 40: Dipole antenna

E1, 11, 21, E21, 31, 41: Antenna element (first antenna element)

E1*a*, 11*a*, 21*a*, E21*a*, 31*a*, 41*a*: Linear section (first linear section)

E1*b*, 11*b*, 21*b*, E21*b*, 31*b*, 41*b*: Linear section (second linear section)

E1*c*, 11*c*, 21*c*, E21*c*, 31*c*, 41*c*: Bending section (first bending section)

E2, 12, 22, E22, 32, 42: Antenna element (second antenna element)

E2*a*, 12*a*, 22*a*, E22*a*, 32*a*, 42*a*: Linear section (third linear section)

E2*b*, 12*b*, 22*b*, E22*b*, 32*b*, 42*b*: Linear section (fourth linear section)

E2*c*, 12*c*, 22*c*, E22*c*, 32*c*, 42*c*: Bending section (second bending section)

F, F1, F2, 11*e*, 12*e*, 21*e*, 22*e*, 33, 43: Feed point

The invention claimed is:

1. A dipole antenna comprising:

a first antenna element; and a second antenna element, the first antenna element including:

a first linear section extending from a first feed point in a first direction; and a second linear section being connected to one of ends of the first linear section via a first bending section, which one of ends of the first linear section is on a side opposite to the first feed point, the second linear section extending from the first bending section in a direction opposite to the first direction, the second antenna element including:

a third linear section extending from a second feed point in the direction opposite to the first direction; and a fourth linear section being connected to one of ends of the third linear section via a second bending section, which one of ends of the third linear section is on a side opposite to the second feed point, the fourth linear section extending from the second bending section in the first direction;

wherein:

the first feed point is provided on an intermediate part of the first linear section;

the second feed point is provided on an intermediate part of the third linear section;

the first linear section is provided between the third linear section and the fourth linear section; and the third linear section is provided between the first linear section and the second linear section.

2. The dipole antenna as set forth in claim 1, wherein:

a length of the second linear section is greater than a sum of (i) a length of a part of the first linear section, which part extends toward the first bending section from the first feed point, and (ii) a length of a part of the third linear section, which part extends toward the second bending section from the second feed point; and a length of the fourth linear section is greater than said sum.

3. The dipole antenna as set forth in claim 1, further comprising:

an electrically conductive member being provided (i) in a gap between the first linear section and the second antenna element or (ii) in a gap between the third linear section and the first antenna element.

4. The dipole antenna as set forth in claim 1, further comprising:

an electrically conductive member, the electrically conductive member being provided so as to cover, via a dielectric sheet, (i) at least a part of a gap between the first linear section and the second antenna element or (ii) at least a part of a gap between the third linear section and the first antenna element.

5. The dipole antenna as set forth in claim 1, wherein:

the first antenna element further includes a first wide width section which (i) is connected to one of ends of the second linear section, which one of ends of the second linear section is on a side opposite to the first bending section, and (ii) has a width which is greater than that of the second linear section; and the second antenna element further includes a second wide width section which (I) is connected to one of ends of the fourth linear section, which one of ends of the fourth linear section is on a side opposite to the second bending section, and (II) has a width which is greater than that of the fourth linear section.

6. The dipole antenna as set forth in claim 5, wherein:

the width of the first wide width section or the width of the second wide width section is not less than c/(128f) (where: f is a frequency within an operation bandwidth; and c is a velocity of light).

7. The dipole antenna as set forth in claim 5, wherein:

a length of the second linear section or a length of the fourth linear section is not less than c/(16f) (where: f is a frequency within an operation bandwidth; and c is a velocity of light).

8. The dipole antenna as set forth in claim 5, further comprising:

an electrically conductive member being provided (i) in a gap between the second bending section and the first wide width section or (ii) in a gap between the first bending section and the second wide width section.

9. The dipole antenna as set forth in claim 5, further comprising:

an electrically conductive member, the electrically conductive member being provided so as to cover, via a dielectric sheet, (i) at least a part of a gap between the second bending section and the first wide width section or (ii) at least a part of a gap between the first bending section and the second wide width section.

10. The dipole antenna as set forth in claim 5, wherein:

the first wide width section is formed to have a rectangular shape whose long side is parallel to the first direction; and the second wide width section is formed to have a rectangular shape whose long side is vertical to the first direction.

11. The dipole antenna as set forth in claim 5, wherein:

the first wide width section is formed to have a rectangular shape whose long side is parallel to the first direction; and the second wide width section is formed to have a rectangular shape whose long side is parallel to the first direction.

12. A dipole antenna comprising:

a first antenna element; and a second antenna element, the first antenna element including:

a first linear section extending from a first feed point in a first direction; and a second linear section being connected to one of ends of the first linear section via a first bending section, which one of ends of the first linear section is on a side opposite to the first feed point, the second linear section extending from the first bending section in a direction opposite to the first direction, the second antenna element including:

a third linear section extending from a second feed point in the direction opposite to the first direction; and a fourth linear section being connected to one of ends of the third linear section via a second bending section, which one of ends of the third linear section is on a side opposite to the second feed point, the fourth linear section extending from the second bending section in the first direction;

wherein:

the first feed point is provided at one of ends of the first linear section, which one of ends of the first linear section is provided on a side opposite to the first bending section;

the second feed point is provided at one of ends of the third linear section, which one of ends of the third linear section is provided on a side opposite to the second bending section; and the first linear section and the third linear section are provided so that the first feed point and the second feed point face each other; and wherein:

a length of the second linear section is greater than a sum of (i) a length of the first linear section and (ii) a length of the third linear section; and a length of the fourth linear section is greater than the sum.

13. The dipole antenna as set forth in claim 12, wherein:

the first antenna element further includes a meander section, at least a part of which has a meander shape; and the second antenna element further includes a meander section, at least a part of which has a meander shape.

14. The dipole antenna as set forth in claim 12, wherein:

the first antenna element further includes a first meander section, at least a part of which has a meander shape, the meander section extending, in the direction opposite to the first direction, from one of ends of the second linear section, which one of ends of the second linear section is on the side opposite to the first bending section; and the second antenna element further includes a second meander section, at least a part of which has a meander shape, the second meander section extending, in the first direction, from one of ends of the fourth linear section, which one of ends of the fourth linear section is on the side opposite to the second bending section.

15. The dipole antenna as set forth in claim 12, wherein:

the first antenna element further includes a first meander section, at least a part of which has a meander shape, the first meander section extending, in a second direction which is perpendicular to the first direction, from one of ends of the second linear section, which one of ends of the second linear section is on the side opposite to the first bending section; and the second antenna element further includes a second meander section, at least a part of which has a meander shape, the second meander section extending, in a direction opposite to the second direction, from one of ends of the fourth linear section, which one of ends of the fourth linear section is on the side opposite to the second bending section.

16. A dipole antenna comprising:

a first antenna element; and a second antenna element, the first antenna element including:

a first linear section extending from a first feed point in a first direction; and a second linear section being connected to one of ends of the first linear section via a first bending section, which one of ends of the first linear section is on a side opposite to the first feed point, the second linear section extending from the first bending section in a direction opposite to the first direction, the second antenna element including:

a third linear section extending from a second feed point in the direction opposite to the first direction; and a fourth linear section being connected to one of ends of the third linear section via a second bending section, which one of ends of the third linear section is on a side opposite to the second feed point, the fourth linear section extending from the second bending section in the first direction;

wherein:

the first feed point is provided at one of ends of the first linear section, which one of ends of the first linear section is provided on a side opposite to the first bending section;

the second feed point is provided at one of ends of the third linear section, which one of ends of the third linear section is provided on a side opposite to the second bending section; and the first linear section and the third linear section are provided so that the first feed point and the second feed point face each other;

wherein:

the first antenna element terminates at one of ends of the second linear section, which one of ends of the second linear section is on the side opposite to the first bending section; and the second antenna element terminates at one of ends of the fourth linear section, which one of ends of the fourth linear section is one the side opposite to the second bending section; and wherein:

a ratio of a length of the first linear section to a length of the second linear section is not less than 0.05 but not more than 0.3; and a ratio of a length of the third linear section to a length of the fourth linear section is not less than 0.05 but not more than 0.3.

17. The dipole antenna as set forth in claim 16, wherein:

the first antenna element is constituted by an electrically conductive film or an electrically conductive wire; and the second antenna element is constituted by an electrically conductive film or an electrically conductive wire.

18. The dipole antenna as set forth in claim 16, wherein:

the dipole antenna receives electric power via a coaxial cable which extends from the first feed point and the second feed point in the first direction or in a direction perpendicular to the first direction.

19. The dipole antenna as set forth in claim 16, wherein: the first linear section and the third linear section are arranged in line.

* * * * *